US006877566B2

(12) United States Patent
Selinger et al.

(10) Patent No.: US 6,877,566 B2
(45) Date of Patent: Apr. 12, 2005

(54) METHOD AND APPARATUS FOR CAUSING PRESSURE VARIATIONS IN A WELLBORE

(75) Inventors: Richard Selinger, 6711-92A Ave., Edmonton, Alberta (CA), T6B 0T5; Clifford J. Anderson, Edmonton (CA); Brian R. Thicke, St. Albert (CA); Michael F. Schoettler, Edmonton (CA)

(73) Assignee: Richard Selinger, Edmonton (CA)

( * ) Notice: Subject to any disclaimer, the term of this patent is extended or adjusted under 35 U.S.C. 154(b) by 0 days.

(21) Appl. No.: 10/205,286

(22) Filed: Jul. 24, 2002

(65) Prior Publication Data

US 2004/0016549 A1 Jan. 29, 2004

(51) Int. Cl.[7] ..... E21B 28/00

(52) U.S. Cl. ..... 166/373; 166/188; 166/177.1; 166/177.7; 166/319

(58) Field of Search ..... 166/177.7, 177.1, 166/319, 316, 308.1, 373, 374, 183, 184, 188, 249, 308; 299/14

(56) References Cited

U.S. PATENT DOCUMENTS

| | | | | | |
|---|---|---|---|---|---|
| 3,209,834 | A | * | 10/1965 | Essary | 166/177.2 |
| 3,743,021 | A | * | 7/1973 | McCauley et al. | 166/311 |
| 4,957,167 | A | * | 9/1990 | Schultz | 166/319 |
| 5,014,788 | A | | 5/1991 | Puri et al. | |
| 5,099,921 | A | * | 3/1992 | Puri et al. | 299/10 |
| 5,147,111 | A | | 9/1992 | Montgomery | |
| 5,332,035 | A | | 7/1994 | Schultz et al. | |
| 5,419,396 | A | * | 5/1995 | Palmer et al. | 166/308.1 |
| 5,494,108 | A | | 2/1996 | Palmer et al. | |
| 6,296,058 | B1 | * | 10/2001 | Brieger | 166/319 |
| 6,325,144 | B1 | | 12/2001 | Turley et al. | |
| 6,325,152 | B1 | * | 12/2001 | Kelley et al. | 166/370 |
| 6,571,874 | B1 | | 6/2003 | Lovenich | |

FOREIGN PATENT DOCUMENTS

WO WO 00/14379 A 3/2000

OTHER PUBLICATIONS

PCT International Search Report for PCT/CA 03/01086 dated Nov. 11, 2003.

* cited by examiner

*Primary Examiner*—David Bagnell
*Assistant Examiner*—Matthew J Smith
(74) *Attorney, Agent, or Firm*—Terrence N. Kuharchuk; Rodman & Rodman

(57) ABSTRACT

A method and apparatus for causing pressure variations in a wellbore. A valve mechanism and a sealing device are provided in the wellbore. The valve mechanism is part of a valve device which may be actuated between an open position and a closed position. The valve device is actuated to the closed position to allow an increase in pressure below the sealing device and is actuated to the open position to allow a fluid to pass through the valve device up the wellbore. The valve device is alternately actuated between the closed position and the open position to cause cyclical pressure variations in the wellbore below the sealing device. The valve device includes the valve mechanism, a fluid passage, a control mechanism for controlling the valve mechanism, and a delay mechanism for delaying the actuation of the valve device from the open position to the closed position. The increase in pressure in the wellbore below the sealing device is caused by either or both of a fluid entering the wellbore from an adjacent formation or by the introduction of a pressurized fluid into the wellbore below the sealing device.

59 Claims, 12 Drawing Sheets

METHOD AND APPARATUS FOR CAUSING PRESSURE VARIATIONS IN A WELLBORE

FIELD OF THE INVENTION

The invention relates to a method and apparatus for causing pressure variations in a wellbore.

BACKGROUND OF THE INVENTION

Large volumes of natural gas, primarily methane, are often contained in coal seams. After a wellbore has been drilled through a coal seam, it is desirable to be able to extract the gas, typically to be used as a resource, but also for safety reasons (to degassify the coal seam) if the coal will be subsequently mined.

Coal deposits tend to exhibit relatively low permeability, which complicates the production of natural gas from coal seams.

Various techniques are known to increase the permeability of a coal deposit and thus stimulate the production of methane from a coal seam. Typically in these techniques, the coal seam adjacent to a wellbore is fractured to help create a direct path from pockets of methane within the coal seam to the wellbore. Fracturing typically involves the introduction into the wellbore of a fluid under pressure.

One such fracturing method is hydraulic fracturing by the injection of liquids. However, hydraulic fracturing is expensive and also creates the potential problem of unwanted fluids in the coal seam or in the wellbore.

Another method, such as that taught in U.S. Pat. No. 5,014,788, which issued to Puri on May 14, 1991, involves the use of a gas, such as carbon dioxide ($CO_2$), injected into the wellbore at pressure. When the pressure of the $CO_2$ within the wellbore has reached a given level, a surface valve is opened to release the $CO_2$ rapidly. The process is repeated several times. This pressure cycling, with rapid depressurization, creates stress fractures within the coal seam, allowing methane within the coal seam to escape into the wellbore. However, the need to introduce a gas into the wellbore, such as $CO_2$, increases the cost of methane extraction. Moreover, the need to pressurize and depressurize the entire wellbore is expensive and requires substantial time, given that a wellbore can extend far below ground. Further, in a deep well, due to the large volume of $CO_2$ that must be released for the pressure cycling described above, pressure cycling can be relatively slow.

Therefore, it would be desirable to be able to increase the permeability of a coal seam without the need to introduce a fluid, either gas or liquid. It would be desirable to increase the permeability of a coal seam more cost-effectively and/or more efficiently. It would also be desirable to increase the permeability of a coal seam, if a fluid is introduced, without needing to pressurize and depressurize the entire wellbore. It would also be desirable to utilize pressure cycling techniques to increase the permeability of coal seams.

The permeability in the vicinity of a wellbore of formations other than coal seams may also be relatively low, either due to the natural state of the formation or due to damage caused during drilling the wellbore or well operations after the wellbore has been drilled.

For example, a formation may become damaged during drilling by the introduction into the wellbore of a drilling fluid under pressure, which drilling fluid may accumulate sand, rock or clay particles as it circulates through the wellbore. These particles may tend to clog or plug a formation adjacent to the wellbore.

Therefore, it would be desirable to be able to increase the permeability of any subject formation adjacent to a wellbore without the need to introduce a fluid, either gas or liquid. It would be desirable to increase the permeability of a subject formation more cost-effectively and/or more efficiently. It would also be desirable to increase the permeability of a subject formation, if a fluid is introduced, without needing to pressurize and depressurize the entire wellbore. It would also be desirable to utilize pressure cycling techniques to increase the permeability of a subject formation.

SUMMARY OF THE INVENTION

The present invention is a method and apparatus for causing pressure variations in a wellbore. The invention involves the use of a valve device which may be actuated between an open position and a closed position and in which the actuation of the valve device from the open position to the closed position can be delayed according to some parameter. The method of the invention involves allowing the pressure in a wellbore to increase with the valve device in the closed position, opening the valve device to allow the pressure to decrease, and then delaying the actuation of the valve device from the open position to the closed position to allow for a significant decrease in pressure in the wellbore before the valve device is actuated to the closed position.

The valve device comprises a fluid passage having a lower end and an upper end, a valve mechanism for actuating the valve device between the open position and the closed position, a control mechanism for controlling the valve mechanism, and a delay mechanism for delaying the actuation of the valve device from the open position to the closed position. The components of the valve device may be combined within a single housing located within or outside of the wellbore or the components of the valve device may be located in separate locations within or outside of the wellbore. Preferably at least the valve mechanism is located within the wellbore.

In one method aspect, the invention is a method for causing pressure variations in a wellbore which is in fluid communication with a subject formation, the method utilizing a valve device comprising a valve mechanism and an associated fluid passage, the wellbore extending between an upper surface end and the subject formation, at least the valve mechanism of the valve device and a lower end of the fluid passage being positioned within the wellbore, wherein the valve device may be actuated between an open position and a closed position, the wellbore being provided with a sealing device positioned in the wellbore above a lower end of the subject formation, wherein the sealing device is associated with the valve device such that when the valve device is in the closed position, the wellbore is sealed below the sealing device, the method comprising:

(a) allowing a fluid from the subject formation to enter the wellbore below the sealing device while the valve device is in the closed position so that a pressure in the wellbore below the sealing device is increased;

(b) actuating the valve device to the open position to allow the fluid to pass through the fluid passage toward the surface end of the wellbore;

(c) actuating the valve device to the closed position after a predetermined delay following actuation of the valve device to the open position; and (d) repeating step (a) and the steps following step (a).

In a second method aspect, the invention is a method for causing pressure variations in a wellbore which is in fluid communication with a subject formation, the method utilizing a valve device comprising a valve mechanism and an associated fluid passage, the wellbore extending between an upper surface end and the subject formation, at least the valve mechanism of the valve device and a lower end of the fluid passage being positioned within the wellbore, wherein the valve device may be actuated between an open position and a closed position, the wellbore being provided with a sealing device positioned in the wellbore above a lower end of the subject formation, wherein the sealing device is associated with the valve device such that when the valve device is in the closed position, the wellbore is sealed below the sealing device, the method comprising:

(a) increasing a pressure in the wellbore below the sealing device while the valve device is in the closed position by introducing a pressurized fluid into the wellbore below the sealing device;

(b) actuating the valve device to the open position to allow the fluid to pass through the fluid passage toward the surface end of the wellbore;

(c) actuating the valve device to the closed position after a predetermined delay following actuation of the valve device to the open position; and (d) repeating step (a) and the steps following step (a).

In an apparatus aspect, the invention is a valve device for causing pressure variations in a wellbore, the valve device comprising:

(a) a fluid passage, the fluid passage having a lower end and an upper end, at least the lower end of the fluid passage being adapted for insertion in the wellbore;

(b) a valve mechanism associated with the fluid passage and adapted for insertion in the wellbore, for actuating the valve device between an open position in which a fluid may pass through the fluid passage from the lower end to the upper end and a closed position in which the fluid is prevented from passing through the fluid passage from the lower end to the upper end;

(c) a control mechanism associated with the valve mechanism for controlling the valve mechanism; and (d) a delay mechanism associated with the valve mechanism for delaying the actuation of the valve device from the open position to the closed position.

The subject formation may be any subterranean formation which is adjacent to the wellbore. Preferably the subject formation is a formation in which it is sought to increase the permeability of the formation by causing pressure variations in the wellbore adjacent to the subject formation. In a preferred embodiment, the subject formation is comprised of a coal seam and the method and apparatus are applied in order to increase the permeability of the coal seam by causing pressure variations in the wellbore adjacent to the coal seam.

Advantageously, different embodiments of the present invention may facilitate increasing the permeability of a subject formation (a) without the need to introduce pressurized fluid, (b) using pressure cycling where pressure in each cycle can be relieved more quickly than previously, (c) more cost-effectively than previously, (d) more efficiently than previously, (e) with less risk of damaging the downhole well through over pressure of an introduced fluid, (f) using a pressurized fluid, however, without the need to pressurize the entire wellbore, and more cost-effectively than previously and more quickly and efficiently than previously.

BRIEF DESCRIPTION OF THE DRAWINGS

Preferred embodiments of the invention will now be described with reference to the attached drawings in which.

DETAILED DESCRIPTION

Figure 1:
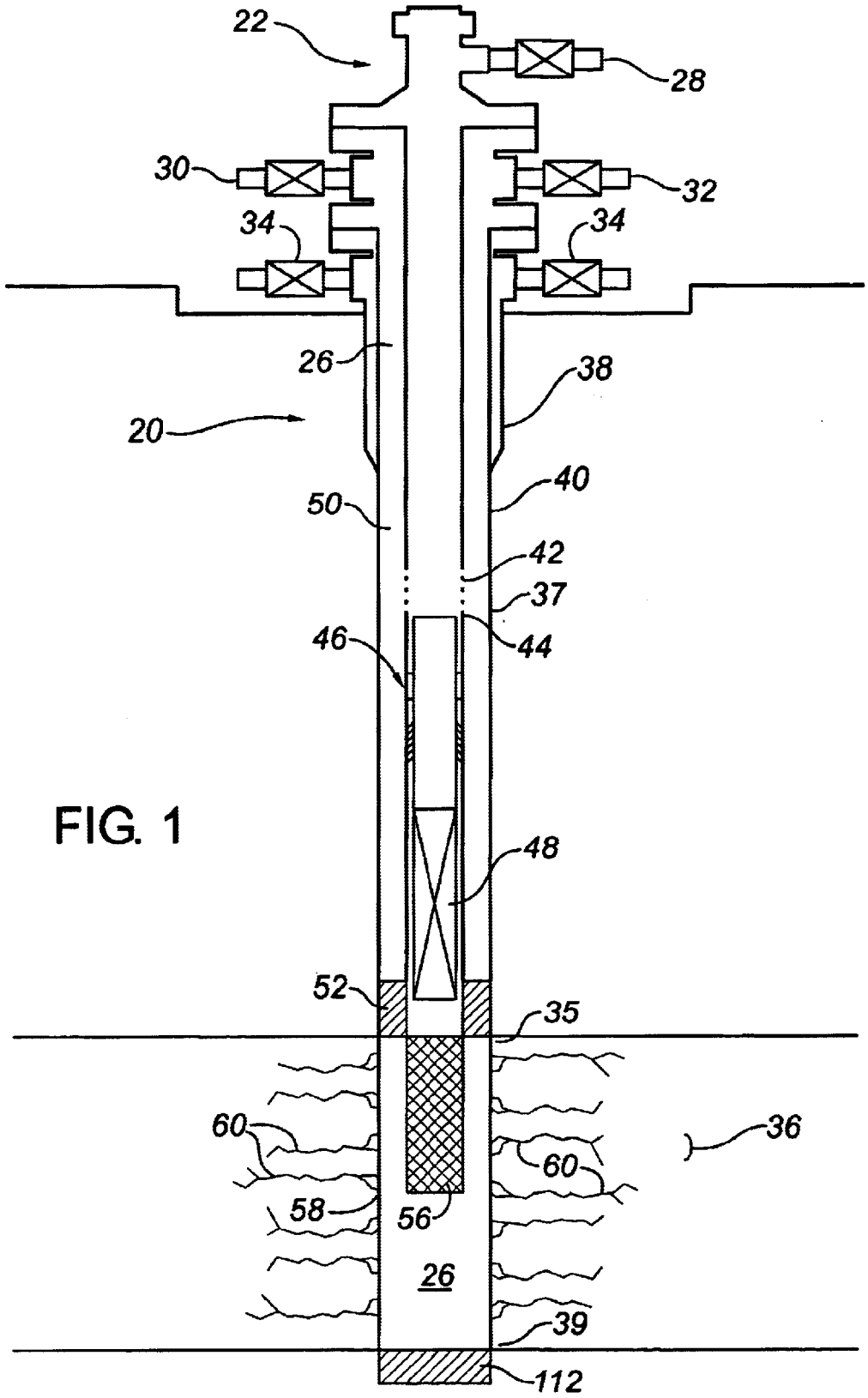
FIG. 1 is a schematic longitudinal cross-sectional view of a wellbore through a coal seam (not to scale), illustrating an approximate placement of a valve device in accordance with an aspect of the present invention.

Referring to FIG. 1, a well, generally depicted as 20 is depicted, in a longitudinal cross-sectional, schematic view (not drawn to scale). The well 20 is comprised of a wellbore 26, which wellbore 26 includes an upper surface end which is defined by a wellhead 22.

The wellhead 22 may contain a number of valves, inlets and outputs, such as those shown in FIG. 1, which may include an outlet for produced water and natural gas 28, an inlet for air, carbon dioxide, nitrogen or other liquids or gases 30, an inlet for soap injection 32, and other inlets and outlets 34.

The wellbore 26 may contain a number of elements, some optional depending upon the desired result and the specific methods used.

As shown in FIG. 1, a subject formation comprising a downhole coal seam 36 is illustrated. The wellbore 26 penetrates the coal seam 36 so that the wellbore 26 extends between the wellhead 22 and the coal seam 36. The coal seam 36 has an upper end 35 and a lower end 39. The wellbore 26 contains a casing string 37 which includes a surface casing 38 and a casing 40 connected to the surface casing 38. A tubing string 42 extends within the casing string 37. An annulus 50 is defined by the space between the casing string 37 and the tubing string 42.

Optionally, a section of perforated tubing 44 may be provided to facilitate water elimination procedures such as soap injection. The perforated tubing 44 makes it possible to inject a frothing agent such as a soap into inlet 32. The frothing agent passes down the annulus 50. The frothing agent mixes with water in the wellbore 26. The mixture of frothing agent and water passes from the annulus 50 to the tubing string 42 via the perforated tubing 44. A flushing fluid is introduced into the wellbore, which flushing fluid may be comprised of either or both of a fluid from the wellbore 26 or of a fluid specifically introduced into the annulus 50 as a flushing fluid. The frothing agent, the water and the flushing fluid is produced up the tubing string 42 to the wellhead 22 as a froth, thus removing the water from the wellbore 26.

The tubing string 42 extends from the wellhead 22 to a sealing device which comprises a top packer 52. The packer 52 provides a seal between the casing string 37 and the tubing string 42 to seal the portion of the wellbore 26 below the packer 52 from the portion of the wellbore 26 above the packer 52. The packer 52 also provides an anchoring function for the tubing string 42 within the casing string 37.

In the preferred embodiments, a valve device 48, which is adapted to be inserted in the wellbore, is connected with the tubing string 42 adjacent to the lower end of the tubing string 42.

The valve device 48 may be connected with the tubing string 42 in any manner. Furthermore, the valve device 48 may be positioned inside the tubing string 42 or outside of the tubing string 42 as long as the valve device 48 is operative to control the passage of fluid from below the packer 52. In the preferred embodiments the valve device 48 is adapted to be inserted inside the tubing string 42.

Referring to FIGS. 3–5, the valve device 48 has a lower end 47 and an upper end 49. A lower mount 43, preferably threaded, is located at the lower end 47 of the valve device 48 for connecting well equipment to the lower end 47 the valve device 48. An upper mount 45, preferably threaded, is located at the upper end 49 of the valve device 48 for attaching the valve device 48 to the tubing seal and lock 46 so that the valve device 48 can be positioned inside of the tubing string 42.

The valve device 48 includes a fluid passage 51 extending through the valve device 48 from the lower end 47 to the upper end 49 such that a lower end of the fluid passage 51 is defined by the lower end 47 of the valve device 48 and an upper end of the fluid passage 51 is defined by the upper end 49 of the valve device 48.

The fluid passage communicates with the tubing string 42. The valve device 48 also includes a valve mechanism 53, a control mechanism 59, and a delay mechanism 55. The valve device 48 may be actuated between an open position and a closed position via the valve mechanism 53. The control mechanism 59 controls the valve mechanism 53. The delay mechanism 55 delays the actuation of the valve device 48 from the open position to the closed position.

In the preferred embodiment, the valve device 48 is connected to the tubing string 42 with a tubing seal and lock 46, which both provides a mechanical connection between the tubing string 42 and the valve device 48 and provides a seal between the tubing string 42 and the valve device 48.

Figure 2:
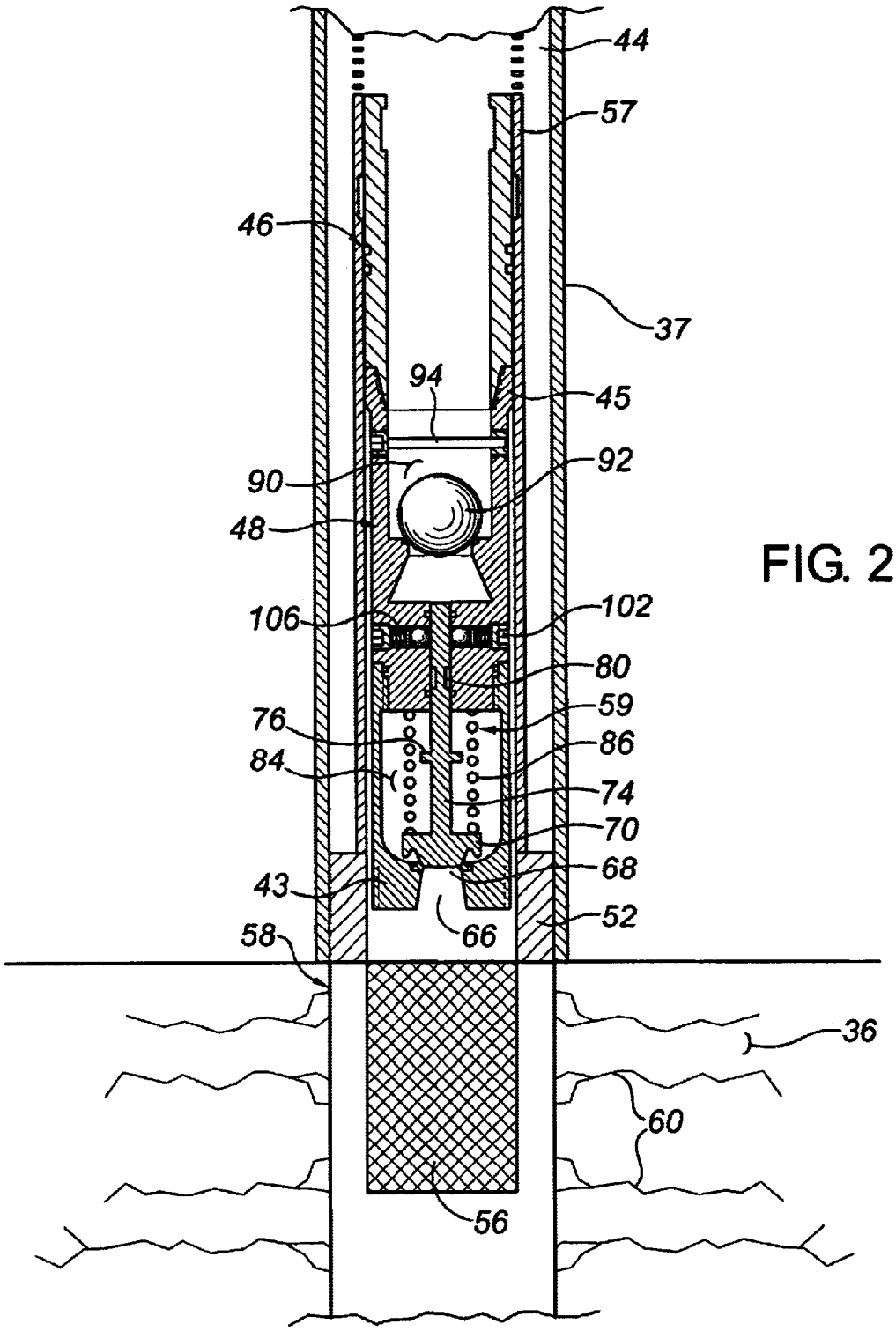
FIG. 2 is a schematic longitudinal cross-sectional magnified view of a portion of the wellbore of FIG. 1, showing details of a preferred embodiment of valve device in accordance with an aspect of the present invention.

Referring to FIG. 2, the tubing seal and lock 46 is located inside the tubing string 42 and can be used to retrieve the valve device 48 for maintenance and to make operational adjustments.

The tubing seal and lock 46 is secured to the valve device using the upper mount 45. The tubing seal and lock 46 latches into a pump seating nipple or profile 57 which is incorporated into the tubing string 42. A running tool (not shown) is used to run the tubing seal and lock 46 and the valve device 48 into the tubing string 42 for latching with the profile 57. A retrieval tool (not shown) is used to release the tubing seal and lock 46 from the profile 57 and to remove the tubing seal and lock 46 and the valve device 48 from the tubing string 42.

Referring to FIG. 2, a filter such as a screen 56 is optionally provided adjacent to the lower end 47 of the valve device 48 to prevent particulate matter from entering the valve device 48, which could interfere with the operation of the valve device 48. The screen 56, where provided, may be connected to the packer 52, the tubing string 42, the casing string 37, the valve device 48 or some other suitable location using any suitable structure or apparatus.

As shown in FIG. 1, the wellbore 26 extends through the coal seam 36. In the section where the wellbore 26 extends through the coal seam 36, a perforated or cut casing 58 extends substantially around the perimeter of the wellbore 26 and preferably throughout substantially the entire depth of the coal seam 36. Coal fractures 60 are depicted by lines extending away from the wellbore 26.

The valve device 48 may be comprised of any device, structure or apparatus which includes a suitable fluid passage 51, valve mechanism 53, control mechanism 59 and delay mechanism 55.

The fluid passage 51 provides a path for fluid to pass through the valve device 48 toward the wellhead 22 when the valve device 48 is in the open position. The fluid passage 51 may be defined by a housing or by some other structure.

The valve mechanism 53 selectively seals and unseals the fluid passage 51 in order to actuate the valve device 48 between the open position and the closed position. The valve mechanism 53 may be comprised of any suitable structure, device or apparatus which is effective to selectively seal and unseal the fluid passage 51, and may include a movable disk, ball, gate or other structure which engages with a seat to seal the fluid passage 51 and disengages from the seat to unseal the fluid passage 51.

The delay mechanism 55 may be comprised of any type of mechanical, hydraulic, pneumatic, electrical, electro-mechanical, electro-hydraulic, electro-pneumatic or other device, structure, apparatus or combination thereof which is capable of delaying the actuation of the valve device 48 from the open position to the closed position.

The valve device 48 may be actuated from the closed position to the open position in response to a particular event or events such as pressure, force or flow variations in the wellbore 26, in response to the passage of time, or in response to some other parameter. The actuating event causes the valve mechanism 53 to actuate the valve device 48 to the open position.

The control mechanism 59 may be comprised of any type of mechanical, hydraulic, pneumatic, electrical, electro-mechanical, electro-hydraulic, electro-pneumatic or other device, structure, apparatus or combination thereof which is capable of controlling the valve mechanism 53 to actuate the valve device 48 to the open position or to the closed position. This mechanism may be positioned within the wellbore 26 or outside of the wellbore 26 and may be included as a component of the valve mechanism 53, the delay mechanism 55, or may be independent thereof.

The delay mechanism 55 is associated with the valve mechanism 53 in order to provide a delay in actuation of the valve device 48 from the open position to the closed position, thus permitting the valve device 48 to remain in the open position for the duration of the delay after the valve device 48 has been actuated to the open position. The delay provided by the delay mechanism 55 may be a time delay, or may be based upon the effects of pressure, force, flow variations or some other parameter upon the delay mechanism 55. The delay mechanism 55 may be associated with the control mechanism 59 or may be separate from the control mechanism 59.

In the preferred embodiments the fluid passage 51, the valve mechanism 53, the control mechanism 59 and the delay mechanism 55 of the valve device 48 are all positioned in close proximity to each other within the wellbore 26 and are contained within a single housing which is adapted to be inserted in the wellbore. All of the components of the valve device 48 could, however, be positioned in close proximity to each other outside of the wellbore 26, such as on the wellhead 22.

Furthermore, the fluid passage 51, the valve mechanism 53, the control mechanism 59 and the delay mechanism 55 of the valve device 48 may be positioned in different locations either within or outside the wellbore 26. For example, some of the components of the valve device 48 may be located within the wellbore 26 and other components of the valve device 48 may be located outside of the wellbore 26 such as at the wellhead 22.

Preferably at least the valve mechanism 53 and the lower end of the fluid passage 51 are positioned in the wellbore 26.

Either or both of the control mechanism 59 and the delay mechanism 55 may be positioned remotely of the valve mechanism 53 either inside or outside of the wellbore 26. For example, either or both of the control mechanism 59 and the delay mechanism 55 may communicate with the valve mechanism via a wireline, by manipulation of apparatus extending within the wellbore 26 or by some other mechanism or technique.

Preferably, however, the fluid passage 51, the valve mechanism 53, the control mechanism 59 and the delay mechanism 55 are all positioned within the wellbore 26 and are preferably integral with, connected with, or otherwise associated with and in close proximity to each other within the wellbore 26.

Where actuation of the valve device 48 and/or the delay provided by the delay mechanism 55 is dependent at least in part upon pressure changes in the wellbore 26, the valve device 48 may be actuated to the open position when the pressure in the wellbore 26 below the packer 52 is increased to a predetermined opening pressure, and the valve device 48 may be actuated to the closed position when the pressure in the wellbore 26 below the packer 52 is decreased to a predetermined closing pressure.

Referring to FIGS. 1–9, in the preferred embodiments the valve device 48 is adapted to be inserted and installed in the wellbore 26 and is preferably capable of being connected with or placed inside the tubing string 42.

FIG. 3 through FIG. 5 illustrate three different embodiments of valve device 48 which provide three different embodiments of delay mechanism 55. The embodiments of FIG. 3 through FIG. 5 are intended only to be exemplary of the many possible designs of valve device 48 which are suitable for use in the practice of the invention and which include a fluid passage 51, a valve mechanism 53, a control mechanism 59 and a delay mechanism 55.

Figure 3A:
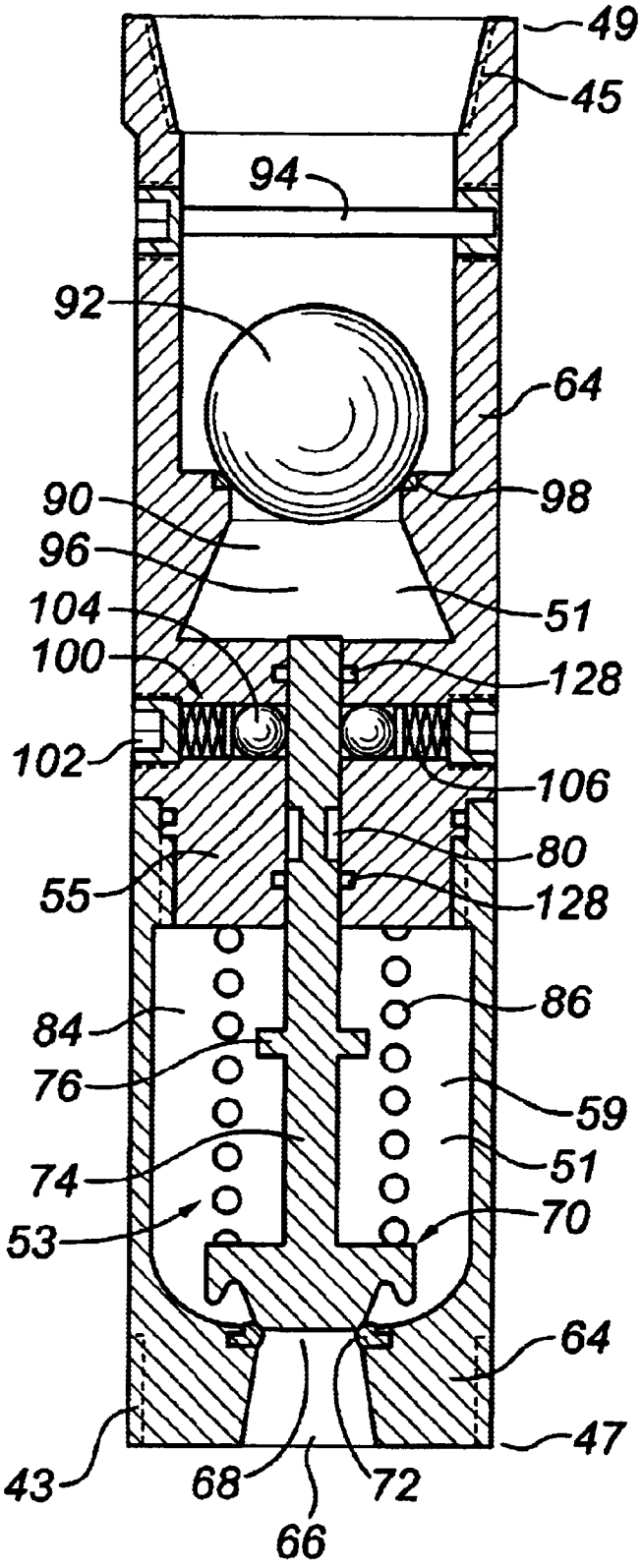
FIG. 3*a* is an isolated longitudinal cross-sectional view of the valve device of FIG. 2, in a closed position.
Figure 3B:
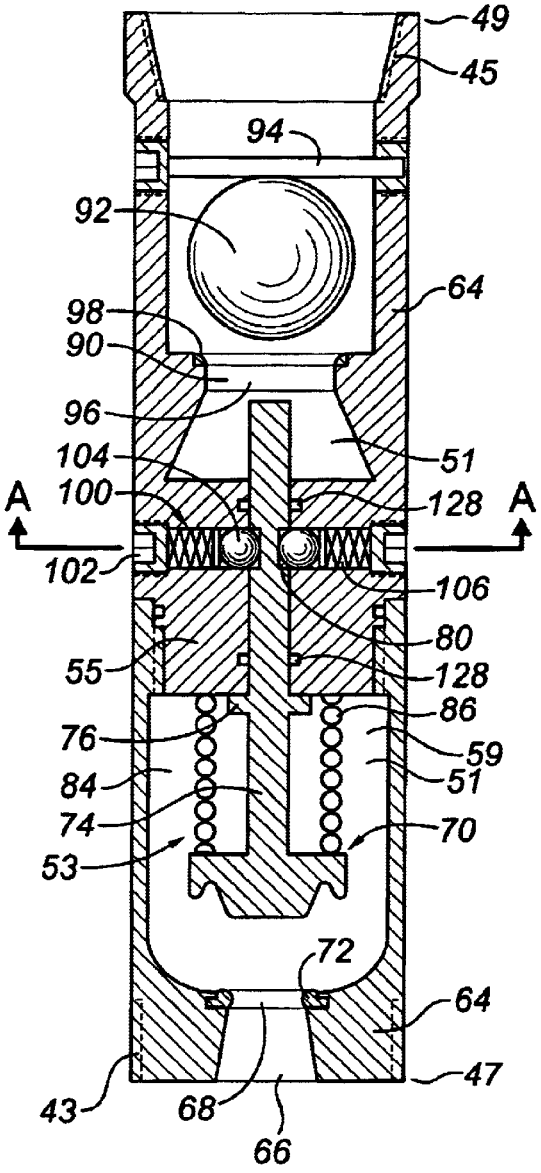
FIG. 3*b* is an isolated longitudinal cross-sectional view of the valve device of FIG. 3*a*, in an open position.
Figure 3C:
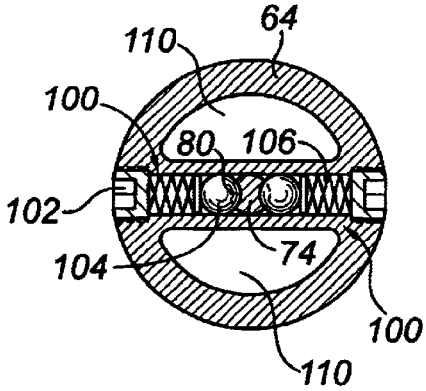
FIG. 3*c* is a transverse cross-sectional view of the valve device of FIG. 3*a* taken along line A—A of FIG. 3*a*.

FIGS. 3*a*–3*c* illustrate a valve device 48 having a mechanical delay mechanism 55, in accordance with an embodiment of the invention.

The valve device 48 of FIG. 3 has a housing 64, defining a lower opening 66 extending into a lower entrance 68. The housing 64 in any of the embodiments of the valve device 48 may be formed of a single piece or may be comprised of a plurality of pieces connected together to form the housing 64.

The valve device 48 also includes the valve mechanism 53 which comprises a reciprocable disk 70 and a lower entrance 68.

In the closed position, as shown in FIG. 3*a*, the lower entrance 68 is blocked by the disk 70, which rests against an elastomeric seat 72. The shape of the disk 70 could vary. The shape of the disk 70 illustrated in FIG. 3*a* is optionally designed to take maximum advantage of upward momentum of fluid to move the disk 70 upward. The disk 70 is connected, integrally or otherwise, to a stem 74, which extends vertically above the disk 72. A stop 76 protrudes from the stem 74. Two indentations 80 are shown formed within the stem 74, which, as will be described in greater detail below, form part of the delay mechanism 55.

A lower cavity 84 is formed within the housing 64, within which lower cavity 84 is located the disk 70 and part of the stem 74 incorporating the stops 76.

The disk 70 is biased toward the lower entrance 68 with a disk biasing device preferably comprising at least one spring 86 which is contained within the lower cavity 84. The control mechanism 59 for the valve mechanism 53 is comprised of the spring 86.

An upper cavity 90 is formed within the housing 64, in which is located a one-way valve apparatus which comprises a reverse flow preventer ball 92 and a ball retainer 94. A top portion of the wider area or upper cavity 90 has a diameter greater than that of the reverse flow preventer ball 92. The ball retainer 94 extends across the upper cavity 90 to prevent the ball 92 from rising above the ball retainer 94. However, the ball retainer 94, while it may extend across the upper cavity 90, does not cover the cross-section of the upper cavity 90 and is designed so as not to significantly affect the flow of fluid through the upper cavity 90. A lower portion of the upper cavity 90 has a circular stop area 96, of circumference smaller than the diameter of the ball 92, which is encircled by an elastomeric seat 98.

In this embodiment, the delay mechanism 55 is located in the housing 64 between the upper cavity 90 and the lower cavity 84. As noted above, the stem indentations 80 form part of the delay mechanism 55. The delay mechanism 55 also includes two detent assemblies 100 extending partway across the valve device 48, towards each other from opposing directions about the stem 74.

Each detent assembly 100 includes a detent member 104 and a detent biasing device 106 which are held in place in the detent assembly 100 with a plug 102. The detent biasing device 106 is located between the plug 102 and the detent member 104, and biases the detent member 104 against the stem 74. Preferably the detent members 104 are balls and the detent biasing devices 106 are springs.

The delay mechanism 55 has been described as having two detent assemblies 100 and two corresponding stem indentations 80. However, the delay mechanism 55 could include one or more detent assemblies 100 and one or more stem indentations 80.

As indicated in FIG. 3*c*, connecting passageways 110 extend between the lower cavity 84 and the upper cavity 90, creating a fluid connection between the lower cavity 84 and the upper cavity 90. The lower cavity 84, the upper cavity 90 and the connecting passageways 110 provide the fluid passage 51 which extends from the lower end 47 to the upper end 49 of the valve device 48.

The valve mechanism 53 of FIG. 3 through FIG. 5 is designed so that it actuates to the open position when a disk force exerted upwards against the disk 70 increases to a predetermined opening pressure or predetermined opening force. This pressure or force is provided by fluid which is contained in the wellbore 26 below the packer 52.

The valve mechanism 53 of FIG. 3 through FIG. 5 actuates to the closed position after a delay which is provided by the delay mechanism 55. The delay may be a time delay or may relate to some other parameter such as a predetermined decrease in the pressure or disk force being exerted against the disk 70.

In the valve device of FIG. 3, the valve device 48 is actuated to the closed position as a result of a decrease in the disk force being exerted upwards against the disk 70 to a predetermined closing pressure or predetermined closing force.

The difference between the pressure or disk force required to open the valve device 48 and the pressure or disk force exerted upward the disk 70 when the valve device 48 closes will be discussed in detail below. However, in the FIG. 3 embodiment, the difference in pressure needed to open and close the valve device 48 (the predetermined decrease in pressure or disk force) is a function of numerous factors, including the biasing characteristics of the spring 86 and the detent biasing devices 106 and the dimensions of the disk 70, the indentations 80, the lower entrance 68 and the lower cavity 84.

Many techniques are possible for installing the valve device 48 in the wellbore 26. One method may be described as follows.

A wellbore 26 is drilled through a coal seam 36. The casing string 37 is inserted into the wellbore 26, and perforated or milled adjacent to the coal seam 36. The depth of the wellbore 26 below the coal seam 36 is preferably minimized in order to minimize the volume of the wellbore 26 between the valve device 48 and the floor (not shown) of the wellbore 26. Minimizing this volume will help reduce the time necessary to build up and release pressure below the packer 52.

It is understood, however, that there may be certain competing interests, where a certain volume in the well below the coal seam 36 may be desired or necessary, such as, for example, to allow for the depositing of debris from the coal seam 36 to accumulate during operation of the valve device 48 or subsequent production of fluids from the coal seam 36.

The wellbore 26 could be specifically drilled into the coal bed 36, or the wellbore 26 could be a re-entry into an existing or abandoned oil or natural gas well that passes through a suitable coal seam 36. In any event, if the floor of the wellbore 26 (not shown) is determined to extend overly far below the bottom of the coal seam 36, the wellbore 26 may be plugged with a plug 112 at a desired level below the coal seam 36, using one or more techniques well known to those skilled in the art.

The packer 52 is preferably placed immediately above the coal seam 36 inside the casing string 37 to form a seal and anchor for the tubing string 42 that extends between the packer 52 and the wellhead 22. The lower end of the tubing string 42 is threaded or otherwise connected with the packer 52. Where utilized, the screen 56 may also be connected to the packer 52.

The valve device 48 is preferably positioned at or near the bottom of the tubing string 42 near the packer 52 using the tubing seal and lock 46. The exact location of placement of the valve device 48 in the wellbore 26 and the means for connecting the valve device 48 with the tubing string 42 will depend upon many factors including the permeability of the coal seam 36, the presence or absence of water in the coal seam 36, the means, if any, used for de-watering the wellbore 26, the need to retrieve the valve device 48 for maintenance and adjustment, and the desire to limit cost.

Subject to considerations arising from these factors, the valve device 48 may be placed at any position within the wellbore 26 or outside of the wellbore 26. For example, the valve device 48 may be located above or below the packer 52 as long as the fluid passage 51 is capable of fluid communication with the subject formation.

In any event, it is preferable for the valve device 48 to be in close proximity to the top of the coal seam 36, to limit, to the extent reasonably possible, the volume of the wellbore 26 between the valve device 48 and the floor of the wellbore 26.

Finally, it may be desirable to sever the casing string 37 at some location above the coal seam 36 in order to separate structurally the portion of the casing string 37 which is penetrating the coal seam 36 and the portion of the casing string 37 which extends to the wellhead 22 from above the coal seam 36. This severing of the casing string 37 may be desirable in order to allow the portion of the casing string 37 which penetrates the coal seam 36 to shift axially with the coal seam 36 instead of being fixed to the portion of the casing string 37 which is connected to the wellhead 22. This in turn may reduce the incidence of failure of the concrete or other interface between the casing string 37 and the surrounding wellbore 26.

In operation, the valve device 48 remains in the closed position, as shown in FIG. 3*a*, until a fluid exerts a sufficient disk force upward against the bottom of the disk 70 to overcome the biasing force of the spring 86. When the upward disk force is sufficient to overcome the downward biasing force of the spring 86, the upward disk force pushes the disk 70 upward, thereby also causing the stem 74 to move upward. The stem 74 moves upward until the stops 76 are impeded by the top of the housing 64 defining the lower cavity 84, as shown in FIG. 3*b*.

When the valve device 48 is in the open position, fluid enters the lower end 47 of the valve device 48 and is pushed upward through the fluid passage 51, which comprises the lower cavity 84, the connecting passageways 110, and the upper cavity 90. The fluid then exits the upper end 49 of the valve device 48 and moves upward in the tubing string 42 to the wellhead 22.

Without the delay mechanism 55, the disk 70 would begin to lower when the disk force drops below the original pressure or disk force required to raise the disk 70. However, the delay mechanism 55 of the FIG. 3 embodiment of valve device 48 delays the closing of the valve device 48 by essentially overriding the control mechanism 59 as follows.

As shown in FIG. 3*b*, when the disk 70 is at its highest point, the stem indentations 80 are aligned with the detent assemblies 100 such that the detent biasing devices 106 push and hold the detent members 104 within the stem indentations 80. The detent biasing force exerted by the detent biasing devices 106 against the detent members 104 within the stem indentations 80 holds the stem 74 and the disk 70 in the raised position of FIG. 3*b*, even after the disk force against the bottom of the disk 70 has dropped below the original force necessary to raise the disk 70 from the closed position shown in FIG. 3*a*. The stronger the biasing force of the detent biasing devices 106, the greater the delay before the disk 70 lowers after the disk force against the disk 70 drops below the original force necessary to raise the disk 70.

The reverse flow preventer ball 92 acts as a one-way valve and helps to prevent back-flow of fluid from the upper end 49 of the valve device 48 to the lower end 47 of the valve device 48, since any back-flow will cause the reverse flow preventer ball 92 to settle within the elastomeric seat 98, thereby blocking or sealing the stop area 96 of the upper cavity 90. The action of the reverse flow preventer ball 92 also helps to prevent clogging of the valve mechanism 53 by preventing debris from above the valve device 48 from descending below the reverse flow preventer ball 92.

The valve device 48 is used to help increase the permeability of a coal seam 36 as follows.

Gas and other fluids within the coal seam 36 form in cleats or voids at a pressure known as formation pressure. The method described below enhances the ability of the fluid to escape from the coal seam 36, into the wellbore 26, and then up the wellbore 26. Since the original pressure in the wellbore 26 is approximately atmospheric pressure, and since formation pressure is typically greater than atmospheric pressure, fluid within the coal seam 36 will tend to move from the higher formation pressure of the coal seam 36 to the lower pressure of the wellbore 26.

Coal deposits typically exhibit a relatively low permeability through the coal matrix. Passages formed from cleats or voids in the coal seam 36 increase the inherent low permeability of coal by allowing fluid to move through the natural passages instead of through the coal matrix.

It is believed that the method of the present invention is effective to create passages through the coal matrix by fracturing the coal matrix, thus increasing the permeability of the coal seam 36.

In areas of the coal seam 36 where there are no natural passages between cleats or voids and the wellbore 26, differential pressure between the cleats or voids and the wellbore 26 may cause fractures 60 to develop in the coal seam 36.

In the method of the invention, pressure is allowed to build up in the wellbore 26 until the pressure provides a sufficient disk force to lift the disk 70 of the valve device 48 and thus actuate the valve device 48 to the open position. The actuation of the valve device 48 to the open position creates the differential pressure which may cause the development of fractures 60 in the coal seam 36 and which may cause lengthening of fractures 60 upon repeated pressure cycles.

In one application of the invention, pressure in the wellbore 26 below the packer 52 may be allowed to build up until it nears or reaches formation pressure. In other applications of the invention, the pressure in the wellbore 26 may be allowed to build to some level below formation pressure, or may be allowed to build for a predetermined length of time.

The pressure is then suddenly released through the valve device 48 once the valve device 48 is actuated to the open position. While the valve device 48 remains open, much of the fluid that was below the packer 52 is forced up through the fluid passage 51 of the valve device 48. The resulting pressure drop in the wellbore 26 below the packer 52 causes stresses in the coal seam 36 between areas that are unable to vent quickly into the wellbore 26 and the surrounding areas that are able to vent. Moreover, the weight of overburden on top of the coal seam 36 may tend to crush certain areas of the coal seam 36 as the pressure is released.

When the disk force against the bottom of the disk 70 lowers to the point where the detent biasing force is no longer sufficient to hold the detent members 104 in the stem indentations 80, the valve device 48 actuates to the closed position under the force of the spring 86, thus allowing the pressure in the wellbore 26 below the packer 52 to build up again.

When the pressure lifts the disk 70 a second time, any fractures 60 commenced from the previous pressure cycle may tend to elongate. Cyclical, abrupt pressure swings may cause continual lengthening of fractures 60 within the coal seam 36.

By repeating this pressure variation process, more fluid is released from the coal seam 36 into the wellbore 26.

Where the volume of the wellbore 26 between the valve device 48 and the well floor has been minimized, there may be no need to introduce a pressurized fluid into the wellbore 26 from above to assist in increasing the pressure in the wellbore 26. The formation pressure alone may be sufficient to achieve the desired pressure build up in the wellbore 26. In certain circumstances, however, it may be necessary or desirable to supplement the increase of pressure derived from fluids contained in the coal seam 36 with the introduction of a pressurized fluid into the wellbore 26 below the packer 52.

It should be noted that different types of coal formation may require different coal fracturing strategies. For example, a coal seam 36 that is relatively impermeable may require a relatively long time for pressure to build in the wellbore 26 before the disk 70 lifts. In such a case, it may be preferable to reduce the disk biasing force of the spring 86 to allow for smaller and more frequent pressure fluctuations to fracture the coal seam 36. However, where the coal seam 36 is more permeable, it may be preferable to increase the disk biasing force of the spring 86 to a level close to the formation pressure, to maximize pressure fluctuations and therefore maximize fracture propagation speed.

Preferably, the valve device 48 releases as much of the pressure from below the packer 52 as possible with each cycle, and does so as quickly as possible. It is therefore desirable to hold the valve device 48 open until much, or substantially all, of the fluid has been removed from the wellbore 26 below the packer 52. Thus, the delay mechanism 55 should preferably allow for much or most of the gas to be removed from the wellbore 26 below the packer 52, even though the pressure and disk force against the bottom of the disk 70 will drop below the disk force that was initially necessary to open the valve device 48. Since the pressure in the wellbore 26 below the packer 52 may become relatively low while the valve device 48 is in the open position, the reverse flow preventer ball 92 is useful to prevent back-flow during the latter stages of venting.

The embodiment of delay mechanism 55 described above has a number of advantages. For example, the delay mechanism 55 is adjustable by changing the spring constant of the spring 86 or the detent biasing device 106. As well, the delay mechanism 55 is sealed inside the valve device 48 to prevent dirt from the clogging the delay mechanism 55.

However, many other types of mechanical delay mechanisms 55 could be used in the invention. The valve device 48 described above incorporates a mechanical delay mechanism 55 having detent members 104 and detent biasing devices 106. However, other delay mechanisms 55 could be used having other forms of suitable mechanical latch mechanisms or other mechanical or partially mechanical mechanisms. Such mechanical delay mechanisms 55 could, for example, include gears, springs, clockwork mechanisms, or ball screw mechanisms.

Alternate embodiments of valve devices 48, delay mechanisms 55 and wellbore 26 configurations are discussed below with reference to FIG. 4 through FIG. 9.

Figure 4A:
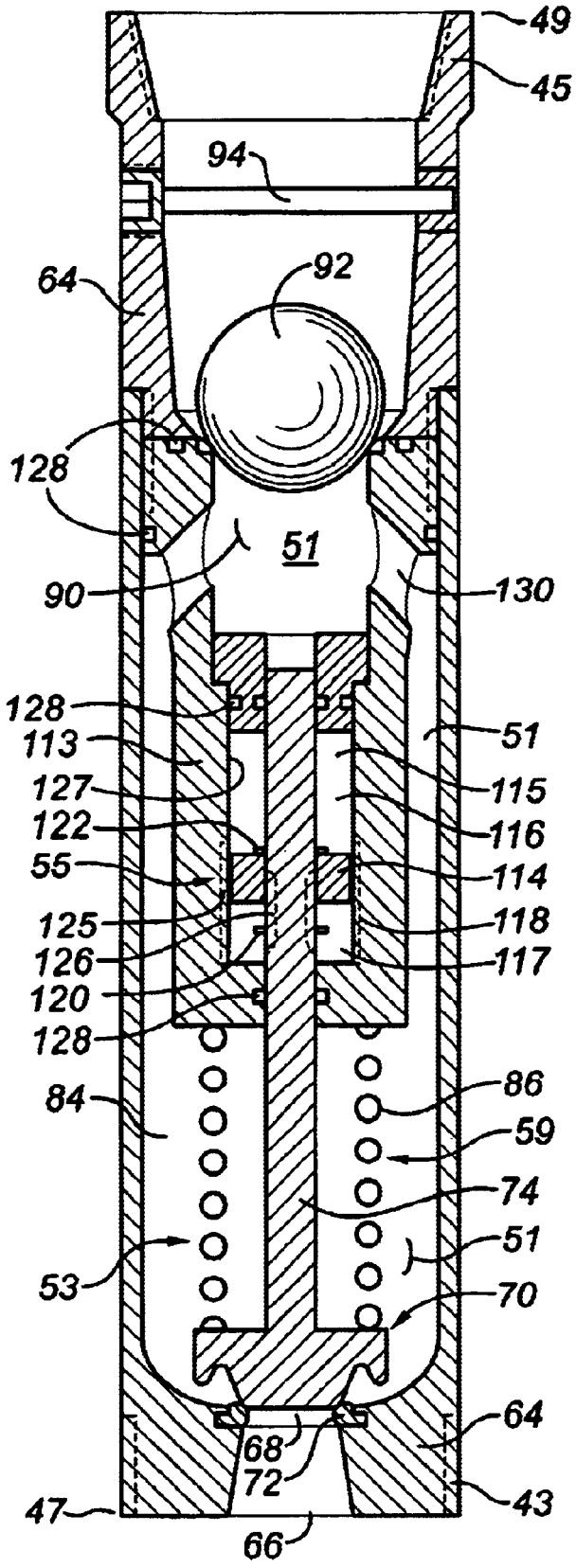
FIG. 4*a* is an isolated longitudinal cross-sectional view of an alternate embodiment of a valve device, in a closed position, in accordance with another aspect of the present invention.
Figure 4B:
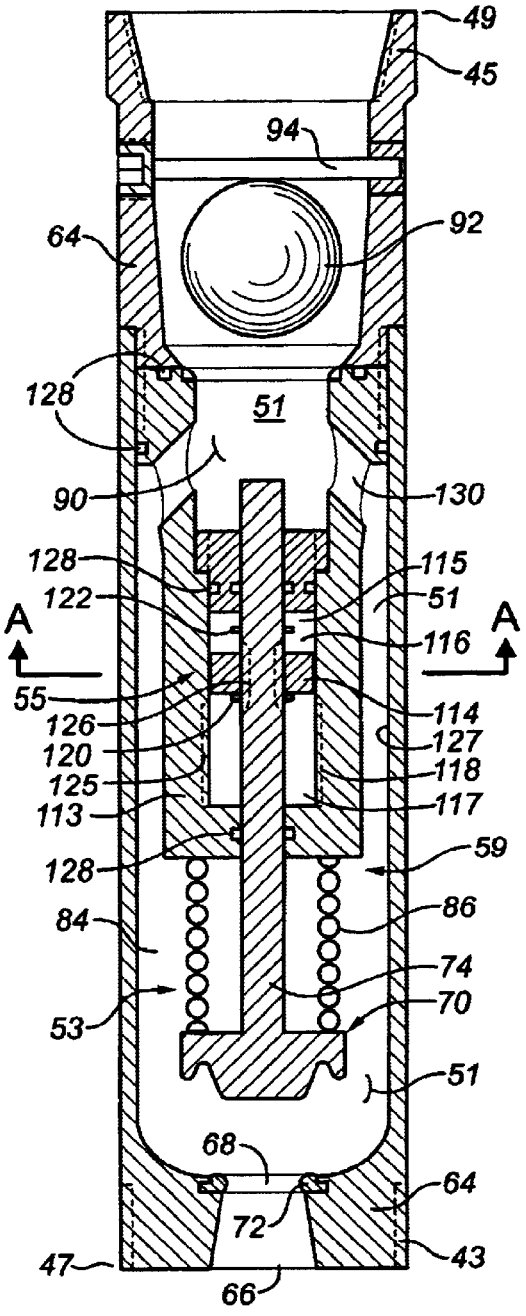
FIG. 4*b* is an isolated longitudinal cross-sectional view of the valve device of FIG. 4*a*, in an open position.
Figure 4C:
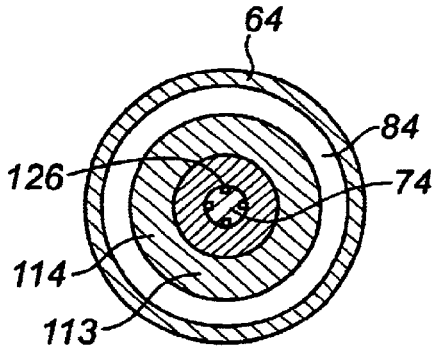
FIG. 4*c* is a transverse cross-sectional view of the valve device of FIG. 4*a* taken along line A—A of FIG. 4*a;*

FIGS. 4*a*, 4*b* and 4*c* illustrate a valve device 48 according to a different embodiment of the invention. The essential difference between the valve device 48 of FIG. 4 and the valve device 48 of FIG. 3 relates to the delay mechanism 55. The valve mechanism 53 of the FIG. 4 embodiment includes the lower entrance 68, the disk 70, the stem 74 and the disk biasing device or spring 86. The fluid passage 51 of the FIG. 5 embodiment includes the lower cavity 84, the upper cavity 90 and connecting conduits 130.

In the FIG. 4 embodiment of valve device 48, the delay mechanism 55 is at least in part comprised of a hydraulic/pneumatic delay mechanism 55. The delay provided by the hydraulic/pneumatic delay mechanism 55 may be dependent upon pressure in the wellbore 26 below the sealing device or may be dependent upon some other parameter such as time.

The hydraulic/pneumatic delay mechanism 55 may be comprised of any structure or apparatus which utilizes the properties of fluids to provide the delay function.

For example, the hydraulic/pneumatic delay mechanism 55 may be comprised of any mechanism which provides for a relatively less obstructed fluid path as the valve device 48 is actuated from the closed position to the open position and which provides for a relatively more obstructed fluid path as the valve device 48 is actuated from the open position to the closed position. This mechanism may in turn be comprised of a two-way valve which provides for different flow rates in each direction, a fluid metering apparatus, or may be comprised of any other comparable mechanism.

The preferred hydraulic/pneumatic delay mechanism 55 of FIG. 4 is comprised of a fluid metering apparatus which includes a piston 114. The piston 114 is contained within a piston chamber 116. The piston chamber 116 is defined by a piston chamber housing 113. The piston 114 divides the piston chamber 116 into an upper piston chamber 115 and a lower piston chamber 117. Towards the lower end of the piston chamber 116, an enlargement 118 is formed within the piston chamber 116, as illustrated by the dotted lines in the housing 64 (the enlargement 118 would be directly visible in another cross-section). An up-pushing stop 120 and a down-pushing stop 122 project from the stem 74 into the piston chamber 116. The piston 114 is located within the chamber 116 between the up-pushing stop 120 and the down-pushing stop 122.

A chamber passageway 125 is provided by an amount of clearance between the piston 114 and an inner piston chamber surface 127. The chamber passageway 125 provides a fluid path for fluid to pass between the upper piston chamber 115 and the lower piston chamber 117.

At least one stem passageway 126 is formed by the stem 74 to provide a fluid path for fluid to pass between the upper piston chamber 115 and the lower piston chamber 117 either between the piston 114 and the stem 74 or within the stem 74. Referring to FIG. 4*c*, four stem passageways 126 are indicated, but any number of stem passageways 126 may be provided, depending upon the design criteria of the delay mechanism 55.

Referring to FIG. 4*b*, the stem passageways 126 extend from below the piston 114 to above the piston 114 when the piston 114 is adjacent the up-pushing stop 120. Referring to FIG. 4*a*, when the piston 114 is adjacent the down-pushing stop 122, the piston 114 blocks the upper entrance/exit of the stem passageway 126. The stem passageways 126 therefore provide a fluid path for fluid to pass from the upper piston chamber 115 to the lower piston chamber 117 while the piston 114 is moving upward, but do not provide a fluid path for fluid to pass from the lower piston chamber 117 to the upper piston chamber 115 when the piston 114 is moving downward.

The piston chamber 116 is isolated from the fluid passage 51 by seals 128 which seal the interfaces between the piston chamber 116 and the stem 74 and the piston chamber 116 and the housing 64. Similar seals 128 are provided in the FIG. 3 and FIG. 5 embodiments of the valve device 48.

In operation, when the valve device 48 is in the closed position shown in FIG. 4*a*, fluid pressure acts upward against the bottom surface of the disk 70 until the disk force is sufficient to overcome the disk biasing force of the spring 86, which is related to a predetermined opening pressure or predetermined opening force.

As the disk 70 opens and while it is open, fluid from below the packer 52 enters the lower end 47 of the valve device 48 and passes through the fluid passage 51, which comprises the lower cavity 84, connecting conduits 130, and the upper cavity 90. The fluid then exits the valve device 48 at its upper end 49 and flows upward through the tubing string 42.

As the disk 70 is moving upward, the piston 114 moves upward in the piston chamber 116 relatively easily, since fluid in the piston chamber 116 is displaced from the upper piston chamber 115 to the lower piston chamber 117 through both the chamber passageway 125 and the stem passageway 126.

When the disk force against the bottom of the disk 70 is less than the disk biasing force of the spring 86, the disk 70 begins to lower, until the down-pushing stop 122 contacts the piston 114.

As shown in FIG. 4*a*, and as described above, when the down-pushing stop 122 contacts the piston 114, the stem passageways 126 are blocked by the piston 114. Fluid within the piston chamber 116 can therefore no longer be displaced through the stem passageways 126 and can only be displaced through the chamber passageway 125. As a result, the piston 114 moves down in the piston chamber 116 more slowly than it moves up in the piston chamber 116 and the relatively slow downward movement of the piston 114 provides the delay which is achieved by the delay mechanism 55.

Accordingly, the delay provided by the delay mechanism 55 in the FIG. 4 embodiment is dependent upon various factors, including the size of the piston chamber 116, the size of the chamber passageway 125, the size and number of stem passageways 126, the viscosity of the fluid in the piston chamber 116, and the number of stem passageways 126 which are blocked during downward movement of the piston 114 in the piston chamber 116.

When the piston 114 passes the enlargement 118, the size of the chamber passageway 125 suddenly increases, allowing the disk 70 to snap closed, thus avoiding the undesirable situation of fluid from below the packer 52 flowing rapidly past a partially open valve mechanism 53. The enlargement 118 also allows the valve device 48 to snap open from the closed position shown in FIG. 4*a*, for the same advantage.

Figure 5A:
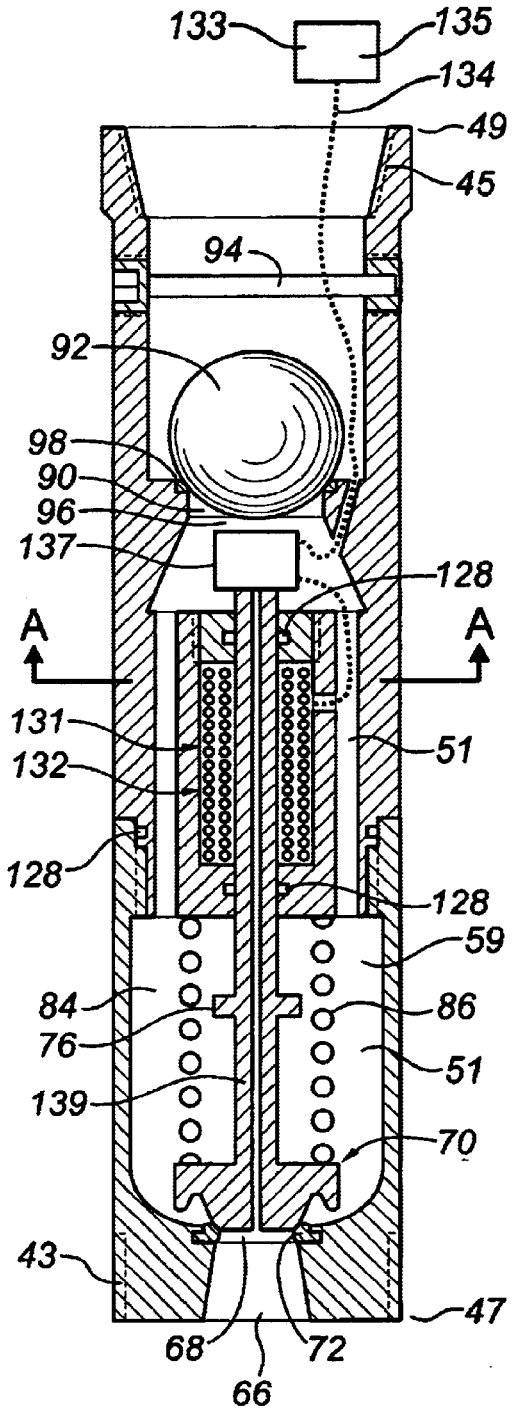
FIG. 5*a* is an isolated longitudinal cross-sectional view of an alternate embodiment of a valve device, in accordance with another aspect of the present invention, in closed position.
Figure 5B:
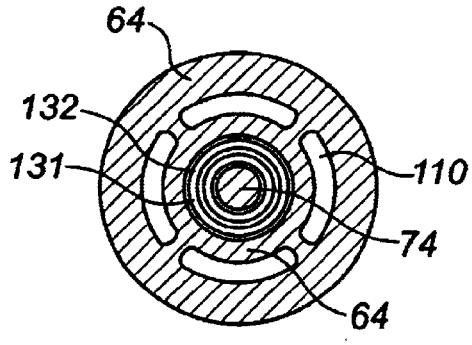
FIG. 5*b* is a transverse cross-sectional view of the valve device of FIG. 5*a* taken along line A—A of FIG. 5*a;*

FIGS. 5*a* and 5*b* illustrate a valve device 48 according to a different embodiment of the invention. The essential difference between the valve device 48 of FIG. 5 and the valve devices 48 of FIG. 3 and FIG. 4 relates to the delay mechanism 55. The valve mechanism 53 of the FIG. 5 embodiment includes the lower entrance 68, the disk 70, the stem 74 and the disk biasing device or spring 86. The fluid passage 51 of the FIG. 5 embodiment includes the lower cavity 84, the upper cavity 90 and connecting passageways 110.

In the FIG. 5 embodiment of valve device 48, the delay mechanism 55 at least in part comprises an electrical switch 131. Preferably the electrical switch 131 is comprised of a solenoid actuator 132. Any other suitable type of electrical switch 131 may, however, be used in place of the solenoid actuator 132.

In addition, the delay mechanism may include an electrical switch 131 together with mechanical components, pneumatic components or hydraulic components such that the delay mechanism 55 is comprised of an electro-mechanical, electro-pneumatic or an electro-hydraulic mechanism. For example, the electrical switch 131 may serve to actuate a mechanical, pneumatic or hydraulic mechanism in order to provide the necessary delay.

As shown in FIG. 5*a*, the solenoid actuator 132 may be installed so that electrical power for the solenoid actuator 132 is provided from the surface of the well 20 or from some location within the wellbore 26 through a power cable 134, which in turn is connected to a electrical power source 133. The power source 133 may be any suitable source of electrical power, including generators, magnetos and batteries and may be located either in the wellbore 26 or outside the wellbore 26. The power cable 134 thus serves to connect the solenoid actuator 132 with the power source 133.

In one configuration of the FIG. 5 embodiment, a timer 135 may be provided on the surface or downhole to energize the solenoid actuator 132 to open and close the valve device 48 on a predetermined time basis. Where utilized, the timer 135 could be connected with the solenoid actuator 132 using a cable integrated with the power cable 134 or could be connected with the solenoid actuator 132 independently of the power cable 134.

In a second configuration of the FIG. 5 embodiment, a pressure sensor 137 may be installed to provide a signal to actuate the solenoid actuator 132 when the disk force against the disk 70 reaches a predetermined opening force and to close the valve device 48 when the disk force against the disk 70 reaches a predetermined closing force. In this configuration, the control mechanism 59 is therefore comprised at least in part by the pressure sensor 137 and solenoid actuator 132.

The pressure sensor 137 may be located in the upper cavity 90 as depicted in FIG. 5, or the pressure sensor 137 may be located in some other location either within or outside of the valve device 48. For example, the pressure sensor 137 may be located in the lower cavity 84, such as on the upper surface of the disk 70 where it may be less exposed to the momentum of the fluid passing through the fluid passage 51 when the valve device 48 is in the open position.

The pressure sensor 137 may alternatively be associated with a pressure port 139 for providing pressure communication between the pressure sensor 137 and the location of the sensed pressure, thus reducing the importance of the placement of the pressure sensor 137 relative to the passage of fluid through the valve device 48.

Alternatively, the actuation of the solenoid actuator 132 may be triggered by some event other than time or disk force in order for the solenoid actuator 132 to provide a suitable delay between in actuation of the valve device 48 from the open position to the closed position. The FIG. 5 embodiment of valve device 48 and delay mechanism 55 therefore provides almost unlimited flexibility for actuation of the valve device 48 between the open position and the closed position, since the delay mechanism 55 is not dependent upon the mechanical, pneumatic or hydraulic features of the delay mechanism 55.

Although all of the embodiments described above contemplate a downhole valve device 48, the same principles would apply if the valve device 48 were used above ground or at ground level, such as for example on the wellhead 22. Of course, if the valve device 48 were used above ground, more time would be required for the pressure in the wellbore 26 below the packer 52 to reach formation pressure, since the volume to be pressurized would be greater than if the valve device 48 were located in closer proximity to the coal seam 36.

Figures 6A, 6B:
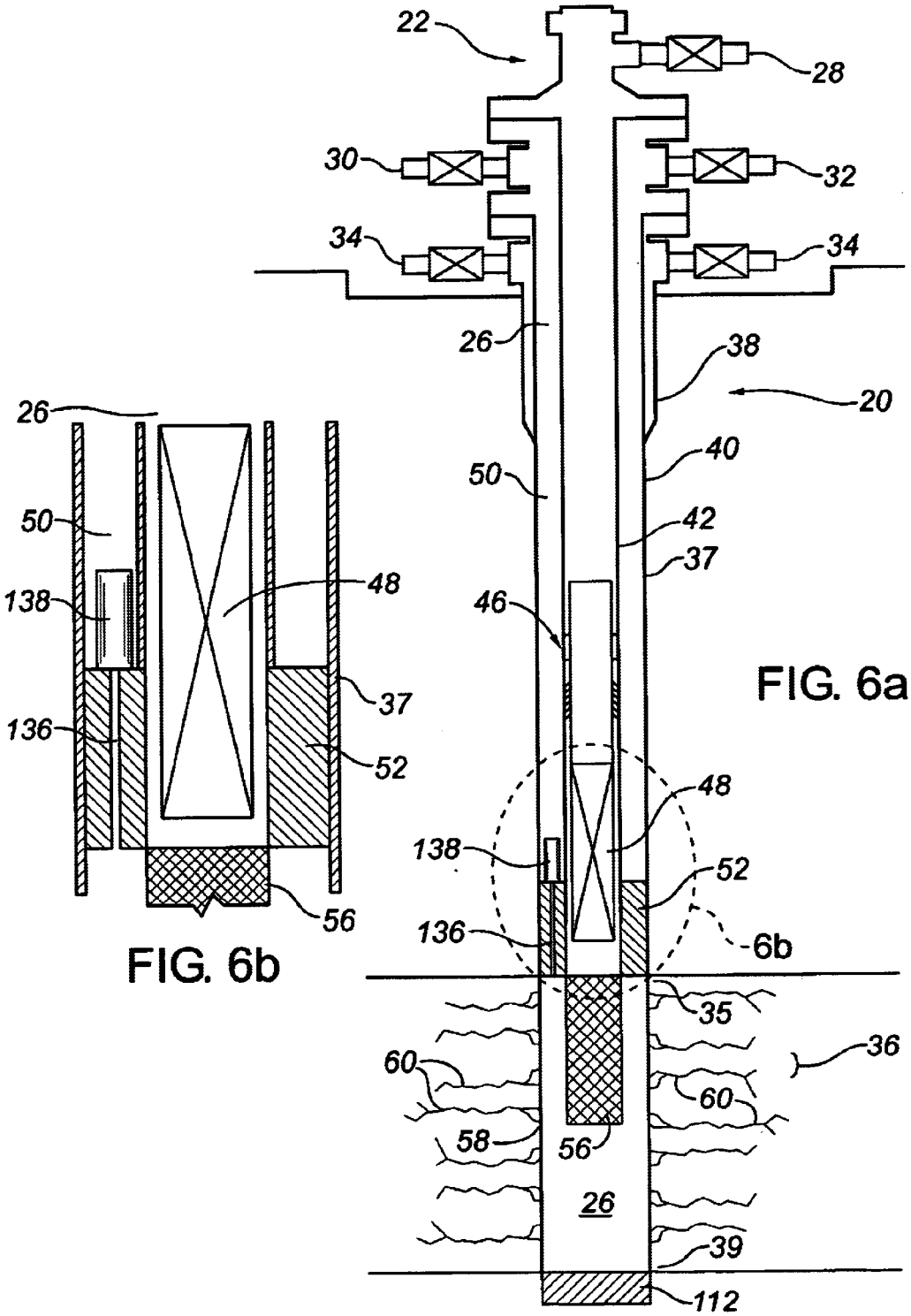
FIG. 6*a* is a schematic longitudinal cross-sectional view (not to scale) of a wellbore, modified from the view of FIG. 1, in accordance with another aspect of the present invention.
FIG. 6*b* is a magnified schematic longitudinal cross-sectional view of a portion of the wellbore depicted in FIG. 6*a;*

FIG. 6 illustrates another embodiment of the invention in which pressurized fluid is injected into the wellbore 26 below the packer 52 to speed up the time between cycles and/or to increase the pressure in the wellbore 26 below the packer 52 to a pressure which is above formation pressure.

If pressurized fluid is introduced into the wellbore 26, care should be taken to ensure that the injection pressure does not damage the integrity of the well 20, and in particular the interface between the casing string 37 and the wellbore 26.

As a general guide, it is believed that the integrity of the wellbore 26 can be safely maintained if an injection pressure is no greater than 150% of the formation pressure. The actual limit for the injection pressure which can be used will depend upon the particular wellbore 26 and the subject formation.

In the embodiments of the invention in which the injection of pressurized fluid is contemplated, the elements within and surrounding the wellbore 26 are essentially the same as described above, with the following modifications.

The wellhead 22 includes the inlet 30 for injecting a pressurized fluid into the well 26. The pressurized fluid can be any suitable fluid such as for example $CO_2$ or nitrogen. Air or other fluids containing elemental oxygen are preferably avoided as injection fluids because they may create a fire hazard in the wellbore 26.

In one variation, the injection fluid is injected down the annulus 50, and then into a pressurized fluid passageway 136 extending through the top packer 52. Preferably, a one-way valve 138 is installed on top of, within, or below the top packer 52. The one-way valve 138 prevents the upward flow of fluid through the one-way valve 138, and also permits coal fracturing as described above without the use of pressurized fluid, if desired.

The pressurized fluid passageway 136 is preferably sized so that the injection rate of pressurized fluid through the pressurized fluid passageway 136 will be significantly less than the rate at which fluid passes through the fluid passage 51 of the valve device 48 when the valve device 48 is in the open position. This will ensure that the injection of pressurized fluid does not interfere with the rapid pressure decrease in the wellbore 26 below the packer 52 which is sought when the valve device 48 is actuated to the open position, and will reduce the need to time the discontinuance of pressurized fluid injection with the actuation of the valve device 48 to the open position.

Alternatively, the introduction of pressurized fluid could be regulated in order to stop pressurized fluid injection when the valve device 48 is actuated to the open position.

In the FIG. 6 embodiment, the perforated tubing 44 above the valve device 48 as shown in FIG. 1 (which allowed for water removal by soap injection) is preferably eliminated, to prevent the pressurized fluid from flowing through the perforated tubing 44. Alternatively, if soap injection is desired the wellbore 26 could be provided with the perforated tubing 44 as long as the wellbore 26 is provided with a mechanism such as a sliding sleeve to facilitate closing the perforations in the perforated tubing 44 when pressurized fluid injection is occurring.

Figures 7A, 7B:
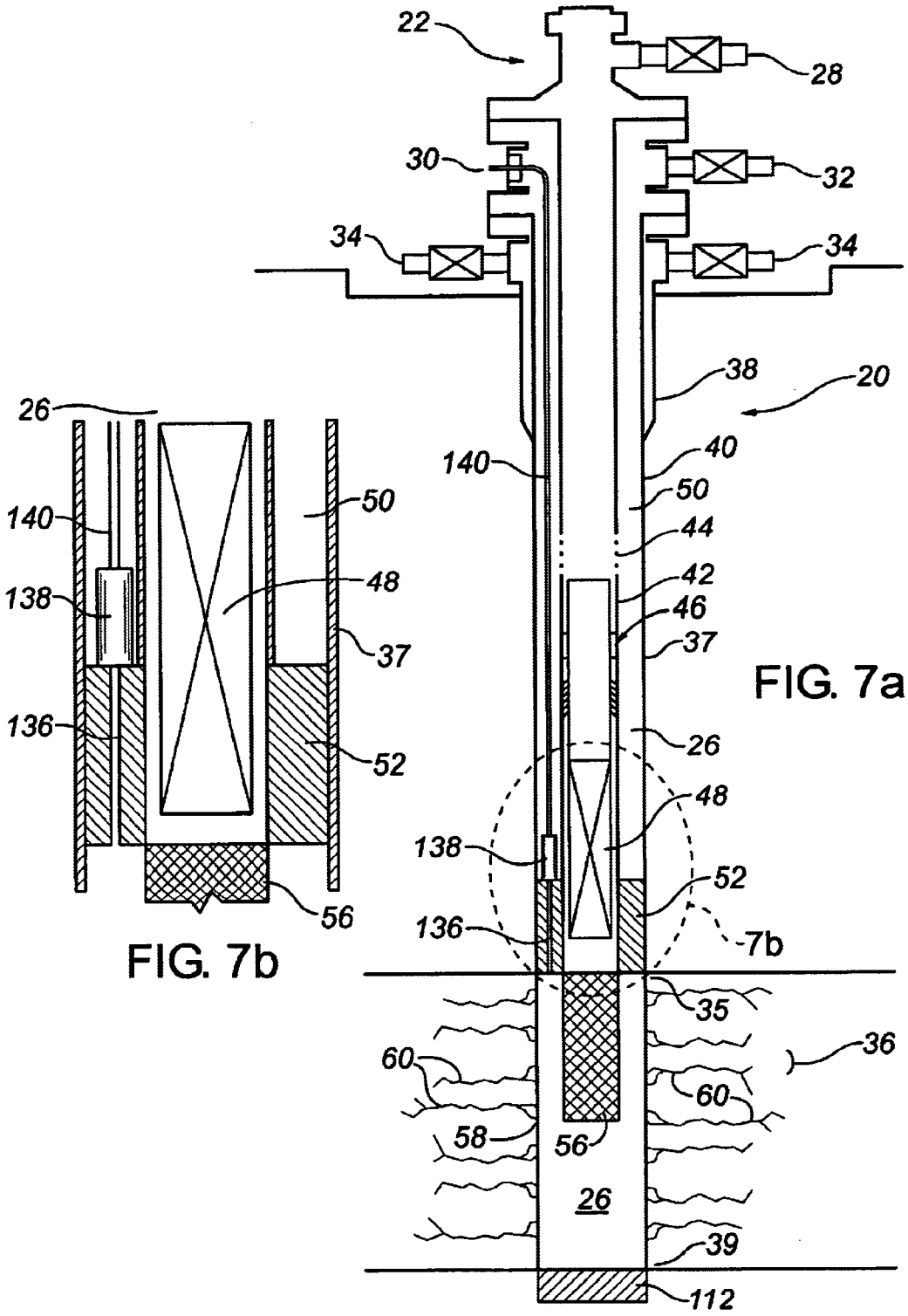
FIG. 7*a* is a schematic longitudinal cross-sectional view (not to scale) of a well-bore, modified from the view of FIG. 1, in accordance with another aspect of the present invention.
FIG. 7*b* is a magnified schematic longitudinal cross-sectional view of a portion of the wellbore depicted in FIG. 7*a;*

Alternatively, a dedicated pressurized fluid line 140 may be extended from the inlet 30 for injecting the pressurized fluid into the well to the pressurized fluid passageway 136, as illustrated in the embodiment of FIG. 7. With this variation, it is not necessary to pressurize the entire annulus 50 with pressurized fluid and therefore less pressurized fluid will be required in order to provide effective pressurized fluid injection. In addition, the FIG. 7 embodiment allows for the injection line 140 to be insulated so that for example, liquid $CO_2$, steam or other extreme temperature liquids could be injected as the pressurized fluid.

Figure 8:
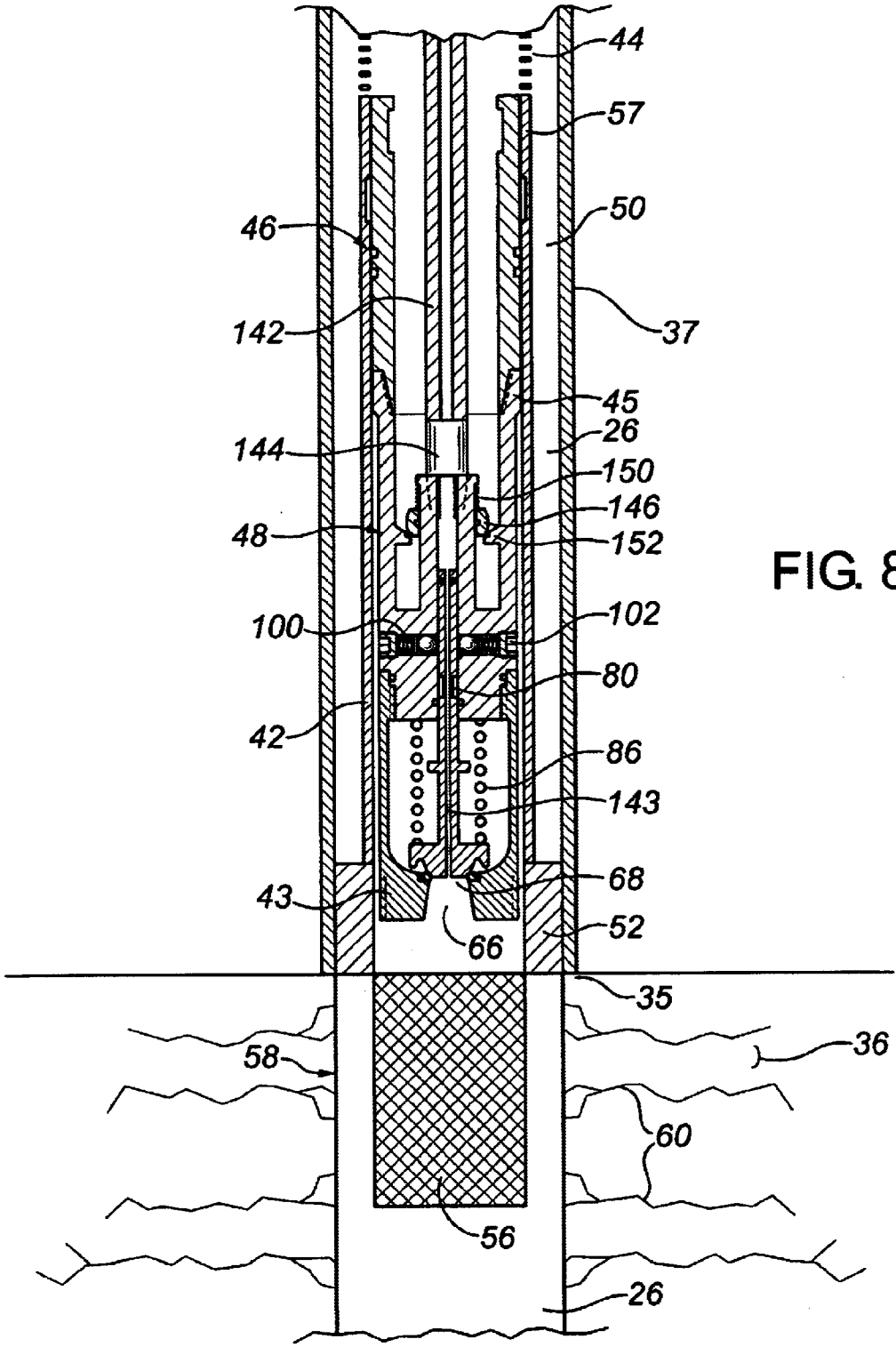
FIG. 8 is a schematic longitudinal cross-sectional view (not to scale) of a portion of a well-bore in accordance with another aspect of the present invention.
Figure 9A:
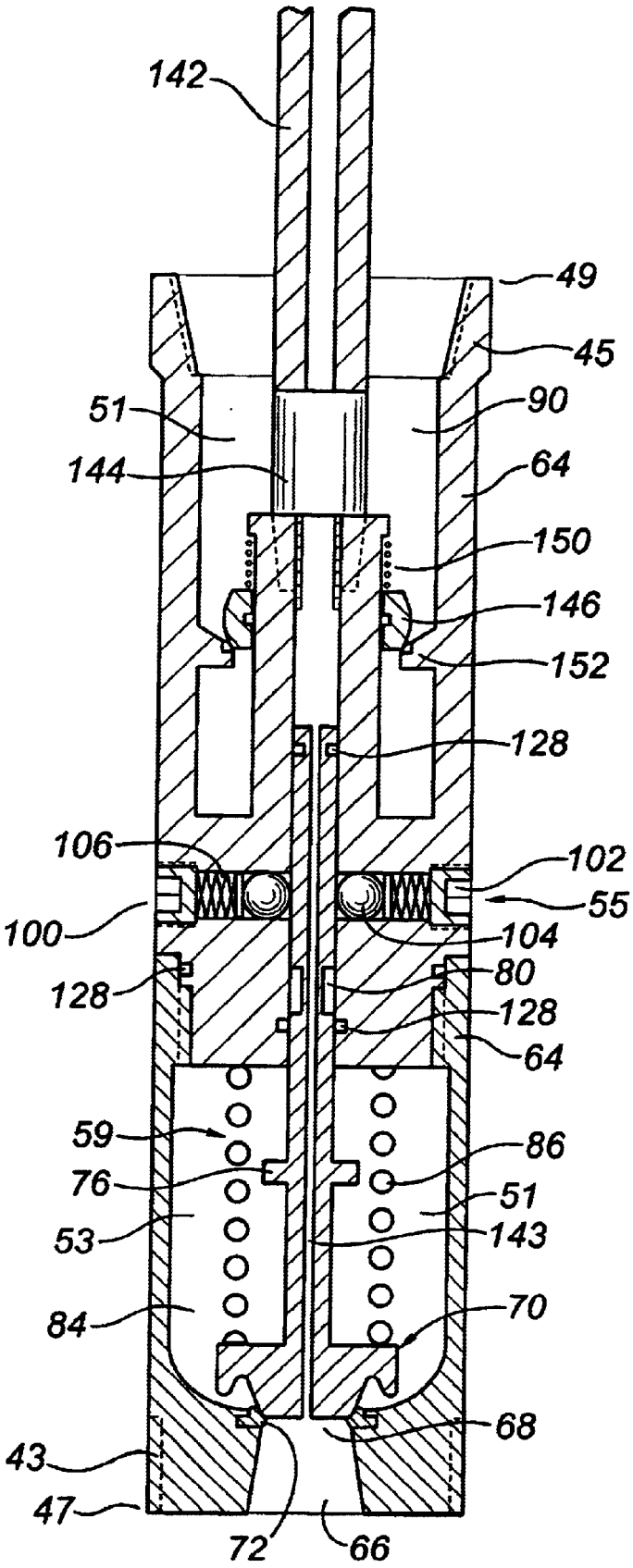
FIG. 9*a* is an isolated longitudinal cross-sectional view of the valve device of FIG. 8, in a closed position.
Figure 9B:
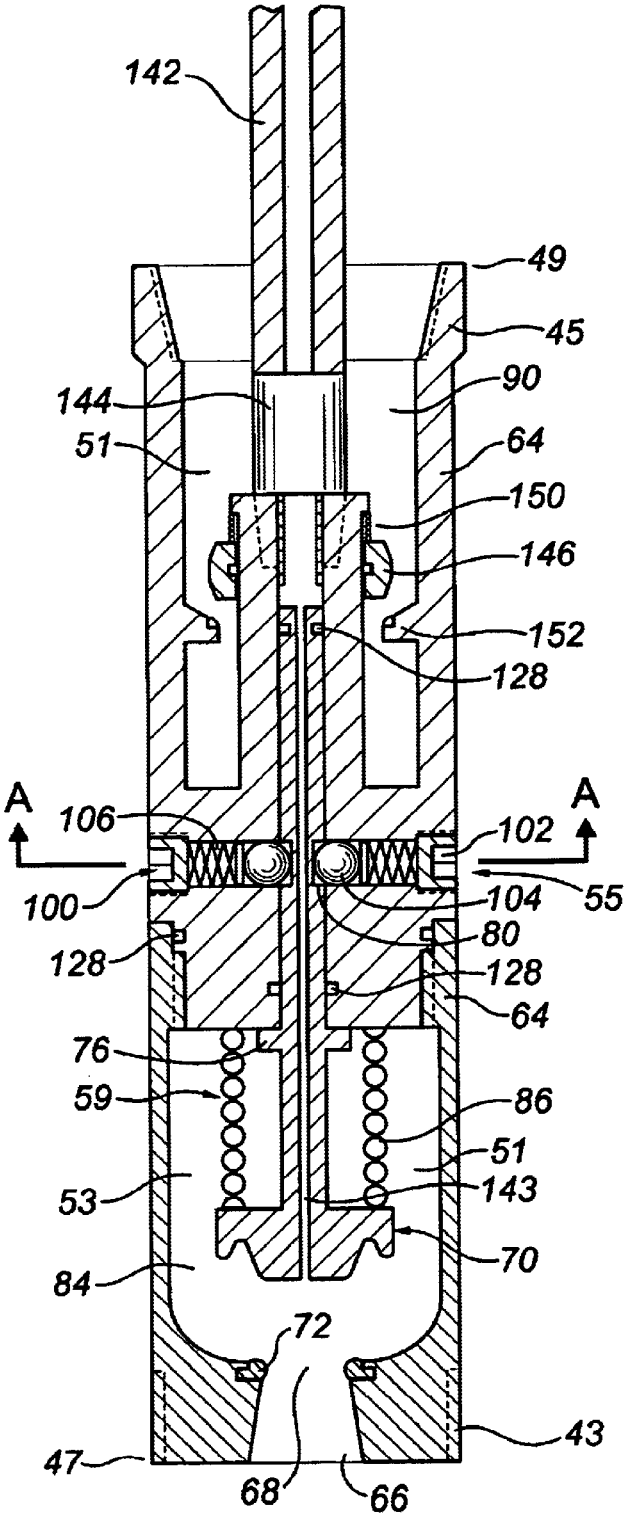
FIG. 9*b* is an isolated longitudinal cross-sectional view of the valve device of FIG. 9*a*, in an open position.

Another embodiment of the invention which contemplates pressurized fluid injection is shown in FIGS. 8, 9*a* and 9*b*. FIG. 8 is a schematic, longitudinal cross-sectional view of a portion of a wellbore 26 through a coal seam 36, illustrating the use of a valve device 48 with a pressurized fluid injection line 142 extending to the valve device 48, and connected to a pressurized fluid passageway 143 through the valve device 48. FIGS. 9*a* and 9*b* are magnified views of a portion of FIG. 8 illustrating the valve device 48 in the closed and open positions, respectively.

As shown in FIGS. 8, 9*a* and 9*b*, the pressurized fluid injection line 142 runs essentially through the center of the wellbore 26, and then extends into or is connected to a one-way valve 144. The one-way valve 144 is sealably connected to the pressurized fluid passageway 143 that extends through the stem 74 and disk 70 of the valve device 48. Such a centrally located injection line 142 may be easier to install than an injection line 140 through the annulus 50 as described above with respect to FIG. 7, and also allows for the use of the perforated tubing 44 and thus soap injection water removal (which would be difficult where the entire annulus 50 is used to inject pressurized gas).

The valve device 48 illustrated in FIGS. 8, 9*a* and 9*b* is similar to that shown in FIGS. 3*a* and 3*b*. The reverse flow preventer ball 92 shown in FIGS. 3*a* and 3*b* is replaced by a reverse flow preventer member 146 which is biased downward by one or more reverse flow springs 150 into an elastomeric seat 152. The purpose of the reverse flow springs 150 is to counteract any frictional forces which may arise between the reverse flow preventer member 146 and the stem 74 and which may interfere with the downward travel of the reverse flow preventer member 146.

The reverse flow springs 150 are preferably only weakly biased so that slight upward pressure of fluid from below is sufficient to raise the reverse flow member 146 to allow fluid to move upward through the valve device 48. However, when the upward pressure is very weak, or if there is downward pressure, the reverse flow springs 150 will cause the reverse flow member 146 to close to prevent fluid from travelling down the valve device 48.

Figure 9C:
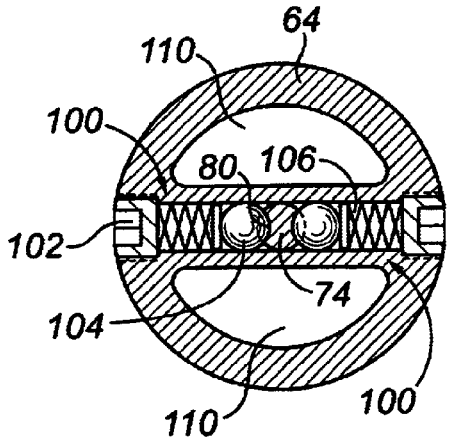
FIG. 9*c* is a transverse cross-sectional view of the valve device of FIG. 9*a* taken along line A—A of FIG. 9*a*.

In the FIGS. 8 and 9 embodiment, pressurized fluid is injected down the wellbore 26, in a manner similar to that described above with respect to FIGS. 6 and 7. Although the embodiment of FIGS. 8, 9*a* and 9*b* is described using the valve device 48 of the FIG. 3 embodiment, any other type of valve device 48 such as those described herein with respect to the FIG. 4 and FIG. 5 embodiments could be substituted for the valve device 48 depicted in the FIGS. 8 and 9 embodiment.

Numerous modifications and variations of the present invention are possible in light of the above teachings. It is therefore to be understood that within the scope of the appended claims, the invention may be practised otherwise than as specifically described herein.

The embodiments of the invention in which an exclusive privilege or property is claimed are defined as follows:

1. A method for causing pressure variations in a wellbore which is in fluid communication with a subject formation, the method utilizing a valve device comprising a valve mechanism and an associated fluid passage, the wellbore extending between an upper surface end and the subject formation, at least the valve mechanism of the valve device and a lower end of the fluid passage being positioned within the wellbore, wherein the valve device may be actuated between an open position and a closed position, the wellbore being provided with a sealing device positioned in the wellbore above a lower end of the subject formation, wherein the sealing device is associated with the valve device such that when the valve device is in the closed position, the wellbore is sealed below the sealing device, the method comprising:

(a) allowing a fluid from the subject formation to enter the wellbore below the sealing device while the valve device is in the closed position so that a pressure in the wellbore below the sealing device is increased, wherein the subject formation is comprised of a coal seam, wherein the wellbore has a perimeter, wherein the wellbore comprises a section which extends within the subject formation, wherein a casing extends substantially around the perimeter of the wellbore and substantially throughout the section of the wellbore which extends within the subject formation, and wherein at least a portion of the casing is perforated or cut;

(b) actuating the valve device to the open position to allow the fluid to pass through the fluid passage toward the surface end of the wellbore;

(c) actuating the valve device to the closed position after a predetermined delay following actuation of the valve device to the open position; and (d) repeating step (a) and the steps following step (a).

2. The method of claim 1 wherein a wellbore plug is installed in the wellbore below the subject formation to seal the wellbore below the subject formation.

3. The method of claim 1, further comprising the step of introducing a pressurized fluid into the wellbore below the sealing device to assist in increasing the pressure below the sealing device.

4. The method of claim 1 wherein the predetermined delay is comprised of a time delay or a reduction in pressure in the wellbore below the sealing device to a predetermined closing pressure.

5. The method of claim 1 wherein the valve device is actuated to the open position when the pressure in the wellbore below the sealing device is increased to a predetermined opening pressure and wherein the valve device is actuated to the closed position when the pressure in the wellbore below the sealing device is decreased to a predetermined closing pressure.

6. The method of claim 1 wherein the valve device is positioned within the wellbore and is connected with a tubing string, wherein the tubing string extends through the wellbore between the valve device and the surface end of the wellbore, wherein the tubing string is comprised of a perforated section between the valve device and the surface end of the wellbore, and wherein the wellbore contains an amount of water, further comprising the following steps:

(a) introducing a frothing agent into the wellbore adjacent to the tubing string so that it mixes with the water;

(b) permitting the frothing agent and the water to enter the perforated section of the tubing string;

(c) introducing a flushing fluid into the wellbore; and (d) producing the frothing agent, the water and the flushing fluid at the surface end of the wellbore through the tubing string.

7. A method for causing pressure variations in a wellbore which is in fluid communication with a subject formation, the method utilizing a valve device comprising a valve mechanism and an associated fluid passage, the wellbore extending between an upper surface end and the subject formation, at least the valve mechanism of the valve device and a lower end of the fluid passage being positioned within the wellbore, wherein the valve device may be actuated between an open position and a closed position, the wellbore being provided with a sealing device positioned in the wellbore above a lower end of the subject formation, wherein the sealing device is associated with the valve device such that when the valve device is in the closed position, the wellbore is sealed below the sealing device, the method comprising:

(a) increasing a pressure in the wellbore below the sealing device while the valve device is in the closed position by introducing a pressurized fluid into the wellbore below the sealing device;

(b) actuating the valve device to the open position to allow the fluid to pass through the fluid passage toward the surface end of the wellbore;

(c) actuating the valve device to the closed position after a predetermined delay following actuation of the valve device to the open position; and (d) repeating step (a) and the steps following step (a).

8. The method of claim 7 wherein the subject formation is comprised of a coal seam.

9. The method of claim 7 wherein a wellbore plug is installed in the wellbore below the subject formation to seal the wellbore below the subject formation.

10. The method of claim 7 wherein the predetermined delay is comprised of a time delay or a reduction in pressure in the wellbore below the sealing device to a predetermined closing pressure.

11. The method of claim 7 wherein the valve device is actuated to the open position when the pressure in the wellbore below the sealing device is increased to a predetermined opening pressure and wherein the valve device is actuated to the closed position when the pressure in the wellbore below the sealing device is decreased to a predetermined closing pressure.

12. The method of claim 7 wherein the valve device is positioned in the wellbore and is connected with a tubing string, wherein the tubing string extends through the wellbore between the valve device and the surface end of the wellbore, wherein the tubing string is comprised of a perforated section between the valve device and the surface end of the wellbore, and wherein the wellbore contains an amount of water, further comprising the following steps:

(a) introducing a frothing agent into the wellbore adjacent to the tubing string so that it mixes with the water;

(b) permitting the frothing agent and the water to enter the perforated section of the tubing string;

(c) introducing a flushing fluid into the wellbore; and (d) producing the frothing agent, the water and the flushing fluid at the surface end of the wellbore through the tubing string.

13. A valve device for causing pressure variations in a wellbore, the valve device comprising:

(a) a fluid passage, the fluid passage having a lower end and an upper end, at least the lower end of the fluid passage being adapted for insertion in the wellbore;

(b) a valve mechanism associated with the fluid passage and adapted for insertion in the wellbore, for actuating the valve device between an open position in which a fluid may pass through the fluid passage from the lower end to the upper end and a closed position in which the fluid is prevented from passing through the fluid passage from the lower end to the upper end;

(c) a control mechanism associated with the valve mechanism for controlling the valve mechanism; and (d) a delay mechanism associated with the valve mechanism for delaying the actuation of the valve device from the open position to the closed position.

14. The valve device of claim 13 wherein the valve device is adapted for insertion in the wellbore.

15. The valve device of claim 14, further comprising a housing for containing the fluid passage, the valve mechanism, the control mechanism and the delay mechanism, wherein the housing is adapted for insertion in the wellbore.

16. The valve device of claim 15 wherein the housing is adapted for insertion in a tubing string and wherein the tubing string is adapted for insertion in the wellbore.

17. The valve device of claim 15 wherein the valve mechanism comprises:

(a) a lower entrance for the fluid passage;

(b) a reciprocable disk for blocking the lower entrance; and (c) a stem attached to and extending from the disk for guiding the disk.

18. The valve device of claim 17 wherein the control mechanism comprises a disk biasing device for providing a disk biasing force to bias the disk toward the lower entrance so that the disk blocks the lower entrance until a disk force applied to the bottom of the disk increases to a predetermined opening force which is sufficient to overcome the biasing force of the disk biasing device and thus actuate the valve device toward the open position.

19. The valve device of claim 18, further comprising a pressurized fluid passageway extending through the stem and the disk for introducing a pressurized fluid through the stem and the disk to the lower end of the fluid passage.

20. The valve device of claim 18 wherein the delay mechanism comprises:

(a) at least one detent member located adjacent to the stem;

(b) a detent biasing device for providing a detent biasing force to bias the detent member against the stem;

(c) a stem indentation that aligns with the detent member when the valve device is in the open position;

wherein when the valve device is in the open position, the stem indentation is aligned with the detent member so that the detent member is biased into the stem indentation by the detent biasing device, thereby maintaining the valve device in the open position until the disk force is reduced to a predetermined closing force at which the disk biasing force overcomes the combined effects of the disk force and the detent biasing force.

21. The valve device of claim 18 wherein the delay mechanism comprises:

(a) a piston chamber located adjacent to the stem, the piston chamber having an inner piston chamber surface;

(b) a reciprocable piston contained within the piston chamber for dividing the piston chamber into an upper piston chamber and a lower piston chamber, wherein a chamber passageway between the upper piston chamber and the lower piston chamber is defined between the inner piston chamber surface and the piston;

(c) at least one stem passageway between the upper piston chamber and the lower piston chamber, which stem passageway is defined by one or both of the stem and the piston;

wherein the chamber passageway and the stem passageway are both open when the valve device is moving toward the open position and wherein only one of the chamber passageway and the stem passageway is open when the valve device is moving toward the closed position.

22. The valve device of claim 21 wherein one of the chamber passageway and the stem passageway is blocked by the piston when the valve device is moving toward the closed position.

23. The valve device of claim 21 wherein the piston chamber has a lower end and wherein the piston chamber is enlarged adjacent to the lower end of the piston chamber.

24. The valve device of claim 18 wherein the delay mechanism comprises an electrical switch which is adapted to actuate the valve device to the closed position when the disk force decreases to a predetermined closing force.

25. The valve device of claim 18 wherein the delay mechanism comprises an electrical switch which is adapted to actuate the valve device to the closed position after a predetermined time delay following the actuation of the valve device to the open position.

26. The valve device of claim 18, further comprising a one-way valve positioned within the fluid passage for preventing the fluid from passing from the upper end to the lower end.

27. The valve device of claim 26 wherein the one-way valve is located in the fluid passage between the upper end and the valve mechanism.

28. The valve device of claim 18, further comprising a filter located adjacent to the lower end, for filtering the fluid before it enters the fluid passage.

29. The valve device of claim 13, further comprising a sealing device associated with the valve device and adapted such that when the valve mechanism and the sealing device are positioned in the wellbore and the valve device is in the closed position, the wellbore is sealed below the sealing device.

30. The valve device of claim 29, further comprising a pressurized fluid passageway extending through the sealing device for facilitating the introduction of a pressurized fluid downward through the sealing device.

31. The valve device of claim 30, further comprising a one-way valve associated with the pressurized fluid passageway for preventing the fluid from passing upward through the sealing device.

32. The valve device of claim 13 wherein the delay mechanism is comprised of a mechanical mechanism, a pneumatic mechanism, a hydraulic mechanism, an electrical mechanism or combinations thereof.

33. The valve device of claim 32 wherein the delay mechanism is comprised of a mechanical mechanism which comprises at least one detent assembly.

34. The valve device of claim 32 wherein the delay mechanism is comprised of a pneumatic mechanism or a hydraulic mechanism which provides for a relatively less obstructed fluid path as the valve device is actuated from the closed position to the open position and which provides for a relatively more obstructed fluid path as the valve device is actuated from the open position to the closed position.

35. The valve device of claim 32 wherein the delay mechanism is comprised of an electrical switch which is adapted to actuate the valve device to the closed position after a predetermined time delay.

36. A valve device for causing pressure variations in a wellbore, the valve device comprising:

(a) a fluid passage, the fluid passage having a lower end and an upper end, at least the lower end of the fluid passage being adapted for insertion in the wellbore;

(b) a valve mechanism associated with the fluid passage and adapted for insertion in the wellbore, for actuating the valve device between an open position in which a fluid may pass through the fluid passage from the lower end to the upper end and a closed position in which the fluid is prevented from passing through the fluid passage from the lower end to the upper end;

(c) a control mechanism associated with the valve mechanism for controlling the valve mechanism; and (d) a delay mechanism associated with the valve mechanism for delaying the actuation of the valve device from the open position to the closed position, wherein the delay mechanism is comprised of a mechanical mechanism, a pneumatic mechanism, a hydraulic mechanism or combinations thereof.

37. The valve device of claim 36 wherein the valve device is adapted for insertion in the wellbore.

38. The valve device of claim 37, further comprising a housing for containing the fluid passage, the valve mechanism, the control mechanism and the delay mechanism, wherein the housing is adapted for insertion in the wellbore.

39. The valve device of claim 38 wherein the housing is adapted for insertion in a tubing string and wherein the tubing string is adapted for insertion in the wellbore.

40. The valve device of claim 36, further comprising a sealing device associated with the valve device and adapted such that when the valve mechanism and the sealing device are positioned in the wellbore and the valve device is in the closed position, the wellbore is sealed below the sealing device.

41. The valve device of claim 40, further comprising a pressurized fluid passageway extending through the sealing device for facilitating the introduction of a pressurized fluid downward through the sealing device.

42. The valve device of claim 41, further comprising a one-way valve associated with the pressurized fluid passageway for preventing the fluid from passing upward through the sealing device.

43. The valve device of claim 36 wherein the delay mechanism is comprised of a mechanical mechanism which comprises at least one detent assembly.

44. The valve device of claim 36 wherein the delay mechanism is comprised of a pneumatic mechanism or a hydraulic mechanism which provides for a relatively less obstructed fluid path as the valve device is actuated from the closed position to the open position and which provides for a relatively more obstructed fluid path as the valve device is actuated from the open position to the closed position.

45. A valve device for causing pressure variations in a wellbore, the valve device comprising:

(a) a fluid passage, the fluid passage having a lower end and an upper end, at least the lower end of the fluid passage being adapted for insertion in the wellbore;

(b) a valve mechanism associated with the fluid passage and adapted for insertion in the wellbore, for actuating the valve device between an open position in which a fluid may pass through the fluid passage from the lower end to the upper end and a closed position in which the fluid is prevented from passing through the fluid passage from the lower end to the upper end, wherein the valve mechanism comprises:

(i) a lower entrance for the fluid passage;

(ii) a reciprocable disk for blocking the lower entrance; and (iii) a stem attached to and extending from the disk for guiding the disk;

(c) a control mechanism associated with the valve mechanism for controlling the valve mechanism; and (d) a delay mechanism associated with the valve mechanism for delaying the actuation of the valve device from the open position to the closed position.

46. The valve device of claim 45 wherein the valve device is adapted for insertion in the wellbore.

47. The valve device of claim 46, further comprising a housing for containing the fluid passage, the valve mechanism, the control mechanism and the delay mechanism, wherein the housing is adapted for insertion in the wellbore.

48. The valve device of claim 47 wherein the housing is adapted for insertion in a tubing string and wherein the tubing string is adapted for insertion in the wellbore.

49. The valve device of claim 45 wherein the control mechanism comprises a disk biasing device for providing a disk biasing force to bias the disk toward the lower entrance so that the disk blocks the lower entrance until a disk force applied to the bottom of the disk increases to a predetermined opening force which is sufficient to overcome the biasing force of the disk biasing device and thus actuate the valve device toward the open position.

50. The valve device of claim 49, further comprising a pressurized fluid passageway extending through the stem and the disk for introducing a pressurized fluid through the stem and the disk to the lower end of the fluid passage.

51. The valve device of claim 49 wherein the delay mechanism comprises:

(a) at least one detent member located adjacent to the stem;

(b) a detent biasing device for providing a detent biasing force to bias the detent member against the stem;

(c) a stem indentation that aligns with the detent member when the valve device is in the open position;

wherein when the valve device is in the open position, the stem indentation is aligned with the detent member so that the detent member is biased into the stem indentation by the detent biasing device, thereby maintaining the valve device in the open position until the disk force is reduced to a predetermined closing force at which the disk biasing force overcomes the combined effects of the disk force and the detent biasing force.

52. The valve device of claim 49 wherein the delay mechanism comprises:

(a) a piston chamber located adjacent to the stem, the piston chamber having an inner piston chamber surface;

(b) a reciprocable piston contained within the piston chamber for dividing the piston chamber into an upper piston chamber and a lower piston chamber, wherein a chamber passageway between the upper piston chamber and the lower piston chamber is defined between the inner piston chamber surface and the piston;

(c) at least one stem passageway between the upper piston chamber and the lower piston chamber, which stem passageway is defined by one or both of the stem and the piston;

wherein the chamber passageway and the stem passageway are both open when the valve device is moving toward the open position and wherein only one of the chamber passageway and the stem passageway is open when the valve device is moving toward the closed position.

53. The valve device of claim 52 wherein one of the chamber passageway and the stem passageway is blocked by the piston when the valve device is moving toward the closed position.

54. The valve device of claim 52 wherein the piston chamber has a lower end and wherein the piston chamber is enlarged adjacent to the lower end of the piston chamber.

55. The valve device of claim 49 wherein the delay mechanism comprises an electrical switch which is adapted to actuate the valve device to the closed position when the disk force decreases to a predetermined closing force.

56. The valve device of claim 49 wherein the delay mechanism comprises an electrical switch which is adapted to actuate the valve device to the closed position after a predetermined time delay following the actuation of the valve device to the open position.

57. The valve device of claim further 49, comprising a one-way valve positioned within the fluid passage for preventing the fluid from passing from the upper end to the lower end.

58. The valve device of claim 57 wherein the one-way valve is located in the fluid passage between the upper end and the valve mechanism.

59. The valve device of claim 49, further comprising a filter located adjacent to the lower end, for filtering the fluid before it enters the fluid passage.

* * * * *